US009355523B2

(12) United States Patent
Robbins et al.

(10) Patent No.: US 9,355,523 B2
(45) Date of Patent: May 31, 2016

(54) COMPUTING WAGERING GAME LUCK

(71) Applicant: WMS Gaming, Inc., Waukegan, IL (US)

(72) Inventors: Richard B. Robbins, Glenview, IL (US); Jeff D. Fleyshman, Chicago, IL (US); Andrew C. Guinn, Chicago, IL (US); Jamie W. Vann, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 0 days.

(21) Appl. No.: 13/791,083

(22) Filed: Mar. 8, 2013

(65) Prior Publication Data

US 2014/0194176 A1 Jul. 10, 2014

Related U.S. Application Data

(60) Provisional application No. 61/748,910, filed on Jan. 4, 2013.

(51) Int. Cl.
*A63F 9/24* (2006.01)
*G07F 17/32* (2006.01)

(52) U.S. Cl.
CPC ..... *G07F 17/326* (2013.01); *G07F 17/32* (2013.01); *G07F 17/323* (2013.01); *G07F 17/3255* (2013.01)

(58) Field of Classification Search
CPC ..... G07F 17/32; G07F 17/3255
USPC ..... 463/16, 20, 25, 42; 273/138.1, 138.2, 273/143 R
See application file for complete search history.

(56) References Cited

U.S. PATENT DOCUMENTS

| | | | | |
|---|---|---|---|---|
| 7,384,335 | B2 | 6/2008 | Boyd et al. | |
| 8,517,819 | B2 | 8/2013 | Kelly et al. | |
| 8,523,650 | B2 | 9/2013 | Kelly et al. | |
| 8,568,218 | B2 | 10/2013 | Kelly et al. | |
| 8,647,188 | B2 * | 2/2014 | Kelly et al. | 463/20 |
| 2002/0103021 | A1 * | 8/2002 | Wood et al. | 463/23 |
| 2003/0013512 | A1 | 1/2003 | Rowe | |
| 2004/0254005 | A1 * | 12/2004 | Shackleford et al. | 463/13 |
| 2007/0060314 | A1 * | 3/2007 | Baerlocher et al. | 463/25 |
| 2007/0167226 | A1 * | 7/2007 | Kelly et al. | 463/29 |
| 2007/0167228 | A1 * | 7/2007 | Tormey | 463/29 |
| 2008/0161101 | A1 * | 7/2008 | Lutnick et al. | 463/25 |
| 2008/0167118 | A1 | 7/2008 | Kroeckel et al. | |
| 2008/0254883 | A1 | 10/2008 | Patel et al. | |
| 2008/0254893 | A1 | 10/2008 | Patel et al. | |

(Continued)

FOREIGN PATENT DOCUMENTS

| | | |
|---|---|---|
| EP | 2372567 | 10/2011 |
| WO | WO-2007030766 | 3/2007 |
| WO | WO-2009062187 | 5/2009 |

*Primary Examiner* — James S McClellan
*Assistant Examiner* — Ryan Hsu
(74) *Attorney, Agent, or Firm* — DeLizio Law, PLLC

(57) ABSTRACT

A wagering game system and its operations are described herein. In some embodiments, the operations can include causing at least one event to occur during play of a wagering game. In some embodiments, the operations can further include determining a difference between occurrence of the at least one event and a theoretical expectation of occurrence associated with the at least one event. In some embodiments, the operations can further include computing a luck factor based on the difference. The luck factor represents luck for occurrence of the at least one event.

26 Claims, 8 Drawing Sheets

(56) References Cited

U.S. PATENT DOCUMENTS

| | | | | |
|---|---|---|---|---|
| 2009/0048010 | A1 | 2/2009 | Kroeckel et al. | |
| 2009/0104960 | A1 | 4/2009 | Kelly et al. | |
| 2009/0104987 | A1 | 4/2009 | Kelly et al. | |
| 2009/0131175 | A1 | 5/2009 | Kelly et al. | |
| 2010/0004060 | A1* | 1/2010 | Filipour et al. | 463/30 |
| 2010/0113162 | A1 | 5/2010 | Vemuri et al. | |
| 2011/0077069 | A1 | 3/2011 | Kroeckel et al. | |
| 2011/0077087 | A1* | 3/2011 | Walker et al. | 463/42 |
| 2011/0117997 | A1 | 5/2011 | Kroeckel et al. | |
| 2011/0124392 | A1 | 5/2011 | Kroeckel et al. | |
| 2011/0269534 | A1 | 11/2011 | Kelly et al. | |
| 2011/0269535 | A1 | 11/2011 | Kelly et al. | |
| 2011/0269545 | A1 | 11/2011 | Kelly et al. | |
| 2011/0269549 | A1 | 11/2011 | Kelly et al. | |
| 2011/0269550 | A1 | 11/2011 | Kelly et al. | |
| 2011/0270425 | A1 | 11/2011 | Kelly et al. | |
| 2011/0281654 | A1 | 11/2011 | Kelly et al. | |
| 2012/0004746 | A1 | 1/2012 | Kelly et al. | |
| 2012/0004747 | A1 | 1/2012 | Kelly et al. | |
| 2012/0015700 | A1 | 1/2012 | Kroeckel et al. | |
| 2012/0015708 | A1 | 1/2012 | Kroeckel et al. | |
| 2012/0058818 | A1 | 3/2012 | Kelly et al. | |
| 2012/0077570 | A1 | 3/2012 | Kelly et al. | |
| 2012/0088571 | A1 | 4/2012 | Kelly et al. | |
| 2012/0088572 | A1 | 4/2012 | Kelly et al. | |
| 2012/0108323 | A1 | 5/2012 | Kelly et al. | |
| 2012/0109344 | A1 | 5/2012 | Kelly et al. | |
| 2013/0123006 | A1 | 5/2013 | Kelly et al. | |
| 2013/0165196 | A1* | 6/2013 | Kroeckel et al. | 463/7 |

* cited by examiner

COMPUTING WAGERING GAME LUCK

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

TECHNICAL FIELD

Embodiments of the inventive subject matter relate generally to wagering game systems and networks that, more particularly, compute wagering game luck.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

Furthermore, the concept of luck is often discussed in the context of wagering games. For example, when an individual who plays wagering games (a "player") wins a wagering game, the player may describe himself as "lucky." When the player wins consistently, or is on a winning streak, the player may describe himself as "hot," or very lucky. If a player hits a run of losses or gets very close to winning but does not win, the player may feel a sense of bad luck or say he is unlucky. Thus, many players feel, and often discuss, the concept of luck in the context of wagering games. The concept of luck, though discussed and felt by players, has so far been largely unused or exploited in the gaming industry. Game operators, game manufacturers, players, and others, can benefit greatly from gaming enhancements that exploit the concept of luck.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into four sections. The first section provides an introduction to embodiments. The second section describes example operations performed by some embodiments while the third section describes example operating environments. The fourth section presents some general comments.

Introduction

This section provides an introduction to some embodiments.

Figure 1:
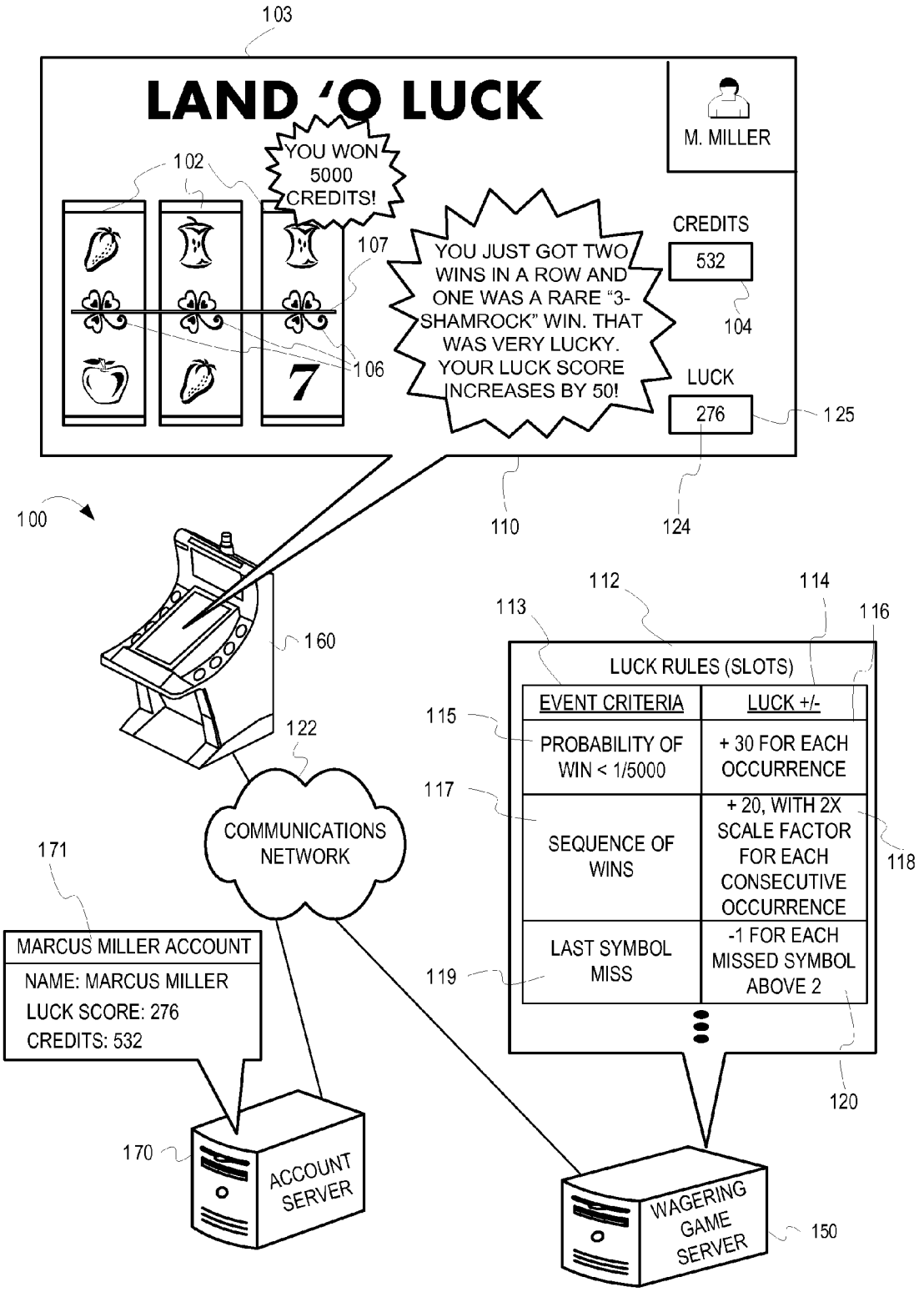
FIG. 1 is an illustration of computing wagering game luck, according to some embodiments.

Some embodiments of the inventive subject matter are directed to computing, tracking, displaying, using, or in any way, exploiting luck in wagering games. For example, a wagering game system ("gaming system") can track luck using a fixed set of "luck rules." The gaming system can detect gaming events that occur in a wagering game and assess characteristics of the gaming events. The gaming system can evaluate elements of the gaming events against specific conditions, or criteria (e.g., stored in luck rules) to qualify and/or quantify the occurrence of the gaming events as being lucky or unlucky. The system can further compute a quantifiable luck factor. In some examples, the gaming system can quantify the degree of the luck factor (e.g., to represent varying levels of both good luck and bad luck). The system can quantify the degree of luck according to a degree to which an occurrence of a wagering game event varies from a theoretical expectation of occurrence for the event (which is described in further detail below). The gaming system can track the luck factor over time, for various conditions, and in specific situations. The gaming system can present the luck factor to a player so that the player can see a quantified degree of luck that the player has had. The system can further utilize the luck factor in a variety of ways described further below. FIG. 1 describes some examples of detecting wagering game events, computing a luck factor based on the evaluation of the events, and using the luck factor.

FIG. 1 is a conceptual diagram that illustrates an example of computing wagering game luck, according to some embodiments. In FIG. 1, a wagering game system ("system") 100 includes a wagering game machine 160 connected to a wagering game server 150 and an account server 170 via a communications network 122. The system can detect when an event occurs via any of the devices connected to the communications network 122. The event can be related to presentation of content for a wagering game 103, such as a wagering game event that occurs via use of the wagering game machine 160, the wagering game server 150, and/or the account server 170. For example, the event may be an outcome of one spin of a wagering game 103 presented via the wagering game machine 160. The outcome represents a configuration of symbols (e.g., graphics of shamrocks, apples, strawberries, lucky sevens, etc.) on reels 102 of the wagering game 103. The outcome of one spin of the wagering game 103 can be generated, using random numbers, according to game play of the wagering game 103. For the game play of the wagering game 103, the system 100 receives a wager amount from a player account 171 associated with a player. The wager amount is a bet by the player that the reels 102 will present a winning configuration of symbols. The winning configurations of symbols are specified in a pay table for the wagering game 103. The pay table specifies which, of all possible configurations of the symbols, is a winning configuration (e.g., the pay table may specify that a configuration of three shamrock symbols 106 presented in a specific alignment on the reels 102 is a winning configuration). For each spin of the reels 102, the system 100 generates a random number. The random number represents one of the possible configurations of the symbols. The system 100 causes the reels 102 to present the one of the configuration of symbols represented by the random number. The presentation of the configuration of symbols on the reels 102 will be referred to as a reel-stop configuration. In FIG. 1, the symbols 106 form a reel-stop configuration where at least some of the symbols align in a winning combination (e.g., the three shamrocks symbols 106 align according to a pay line 107). Because the reel-stop configuration is a winning configuration, the system pays out a number of credits (a "payout"), which, in some examples, is a scale factor of the bet amount. The payout is added to a credit meter 104 for the player account 171. Thus, FIG. 1 illustrates one example of an event that is a winning outcome for the wagering game 103.

Based occurrence of the event (e.g., the winning outcome for the wagering game 103), the system 100 determines whether there is a difference between an occurrence of the event and a theoretical expectation of occurrence of the event according to luck rules 112. The theoretical expectation of occurrence for the event can be a normal, or theoretical way the event would be expected to play out via the wagering game 103. The system 100, therefore, can determine a degree of variance, or deviation from the normal, or theoretical way the event would be expected to play out. The system 100 can refer to the luck rules 112 to determine what differences exists between actual occurrences of events and theoretical expectations of occurrences for the events and, based on the differences, determine whether to change a luck factor and by how much to change the luck factor. In some examples, the luck rules 112 may include a listing of theoretical expectations of occurrence and/or a description of deviations from theoretical expectations of occurrence. In some embodiments, the system 100 compares characteristics, values, etc., about the actual occurrence of the events to the theoretical expectations of occurrence listed in the luck rules 112 to determine whether there is a difference. If the system detects a difference, the system 100 computes (e.g., generates, modifies, etc.) a quantifiable luck factor. For instance, the system 100 generates a luck score 124 or modifies a value for the luck score 124. In some embodiments, the system 100 causes the luck factor to increase when the system 100 determines that the actual events are more advantageous or numerically superior to theoretical expectation of occurrence. The system 100 can also cause the luck factor to decrease when the system 100 determines that the actual events are less advantageous or numerically inferior to the theoretical expectation of occurrence. The system 100 can track the luck factor over time and in specific scenarios. Further, the system 100 can use the luck factor in various ways, such as displaying the luck factor as the luck score 124 in a luck meter 125.

More specifically, when the system 100 detects the occurrence of the event (e.g., when the system 100 detects the winning outcome), the system 100 evaluates the event against luck rules 112. The luck rules 112 include a variety of event criteria 113 that relate to the event. The luck rules 112 also include luck parameters 114 that correspond to the event criteria 113. The system 100 analyzes characteristics of the occurrence of the event and the context in which the event occurred to determine whether the occurrence of the event meets one or more of the event criteria 113. The system 100 then detects which of the luck parameters 114 to use for computing a luck factor. The luck factor can be quantified as the luck score 124 that can be presented via the luck meter 125. In some embodiments, the luck score 124 is separate from a credit balance in the credit meter 104 and/or separate from other game metrics (e.g., game scores, game accomplishments, etc.). In one example, the system 100 determines that the winning outcome for the wagering game 103 meets a first criterion 115 (i.e., that the probability of the reel-stop configuration of the three shamrock symbols 106 aligning along the payline 107 has odds of occurrence less than two-hundredths of a percent (0.02%)). In other words, according to mathematical probability (for a given set of circumstances of the wagering game 103, such as a number of pay lines selected), the winning outcome of three shamrock symbols 106, for the wagering game 103, is expected to occur less than once in every five-thousand spins (i.e., an odds of less than 1/5000, or 0.02%). Obtaining a winning outcome with odds of less than 1/5000 is very rare, so statistically such an outcome is unexpected. The luck rules 112 specify a condition related to the mathematical probability for the winning outcome in the criterion 115. The system 100 determines that the occurrence of the event meets the criterion 115 (i.e., that the winning outcome of three shamrock symbols 106 had less than a 1/5000 chance of occurrence), and, therefore, qualifies as a lucky event that was beyond a mathematical expectation for a given spin. The criterion 115 can take into account multiple aspects of the event, such as a timing for the event. For instance, to obtain an outcome that typically occurs less than once for every five thousand spins, a player would expect to play for a very long time before obtaining that outcome. If, however, the player were to obtain that outcome within 10 minutes of beginning play for a wagering game session or after first registering for a wagering game player account, or if the player obtained that outcome more than once in a day (e.g., obtaining the winning outcome twice in five hundred spins) would greatly exceed the expected likeliness of occurrence. Thus, receiving that winning outcome within an unexpected time period or multiple times within an unexpected number of plays, would be an indication of exceptionally good luck.

The system 100 then computes a luck factor based on meeting the criterion 115. For example, the system 100 selects a luck parameter 116 that corresponds to the criterion 115 and the system 100 uses the luck parameter 116 to compute a number of luck points to be added to the luck score 124. The luck parameter 116 specifies that the system 100 should cause the luck score 124 to increment by 30 points.

The occurrence of the event (e.g., the occurrence of the winning outcome) may apply to more than one of the criteria 113. The system 100, therefore, can compute a luck factor using multiple ones of the luck parameters 114 for the occurrence of the event. By qualifying under multiple ones of the criteria 113, the system 100 can compute a greater value for the luck factor.

The system 100 can evaluate and compute luck based on a variety of characteristics of the event, such as a probability of occurrence of the event as mentioned above. Another example criterion is the occurrence of the event within a time period or number of plays. Yet another example criterion is a frequency or sequence of occurrence of the event. For example, event criterion 117 indicates that if the event occurs sequentially, then the sequential occurrence qualifies for luck parameter 118. The luck parameter 118 indicates that each consecutive occurrence of a winning outcome will cause the luck score 124 to increase by a certain number of points with a multiplication factor (e.g., 20+ points multiplied by 2 for each consecutive win). For instance, the system 100 would award +20 luck points for the first consecutive occurrence of a win event, +40 luck points for a second consecutive occurrence of a win event, +80 luck points for a third consecutive occurrence of a win event, and so forth. A player would not expect to win consecutively, so one consecutive win would be lucky. Two or more would be exceptionally lucky. The system 100, therefore, increases the luck factor by degrees proportional to the increasing degree to which the event varies from a likely, or expected, result.

The system 100 can also compute bad luck (e.g., negative luck values). For example, if the event were to be a missed win, or "near win", then the event would qualify for the event criterion 119. A near win occurs when game symbols are revealed consecutively, as if they will result in a win, but on the last symbol to be revealed the winning outcome does not happen, thus "nearly" winning. For instance, the reels 102 may spin during game play and be revealed from left to right (e.g., the left-most of the reels 102 stops spinning before the middle or right-most of the reels 102 stops spinning, and the middle one of the reels 102 stops spinning before the right-most one of the reels 102 stops spinning). The consecutive stopping of reels adds anticipation to the game play, which adds to the fun of wagering games. However, when the reels 102 are slowly revealing what may look like a winning outcome, a player may begin to expect that the winning outcome will occur. As more of the symbols line up in a potentially winning outcome, the feeling of expectation for a win will grow. Therefore, if on the last symbol to be revealed, the result is a losing outcome, the player may feel a sense of bad luck. The system 100 can quantify that perceived bad luck and deduct it from the luck score 124. For example, the system 100 can apply the luck parameter 120 to cause a deduction of one luck point for a near win, where the number of symbols previously revealed before the last symbol is revealed factors into the number of subtracted luck points. For instance, some wagering games have three reels, some have four, some have five, and so forth. If a game has three reels, then a missed win would result in a deduction of one luck point (i.e., the first two reels reveal symbols that look like a win may happen, but the third reel reveals a symbol that does not complete the winning configuration of symbols). If the game has four reels, then a near win would result in a deduction of two luck points (i.e., the first three reels reveal symbols that look like a win may happen, but the fourth reel reveals a symbol that does not complete the winning configuration of symbols). For a five-reel game, then three luck points would be deducted for a near win, and so forth.

Further, some embodiments of the inventive subject matter describe examples of computing wagering game luck in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, for purposes of the present detailed description, a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. It should be noted, however, that some embodiments could compute luck without requiring a use of a player account. For instance, FIG. 1 illustrates an example that utilizes a player account 171 according to account-based wagering. Other embodiments, however, can compute a luck factor and generate a coded identifier (e.g., a barcode) that specifies a luck score. A player can use the coded identifier (e.g., scan the coded identifier) when moving between gaming machines. When scanned, the system can detect the player's previous luck balance. Some embodiments can transmit an indication of luck factors to non-gaming accounts, to personal mobile devices, to data storage devices, etc. For example, some embodiments can transfer luck scores to a mobile device, which then stores the luck score and reports the luck score to a wagering game device (e.g., for presentation via a luck meter or for other uses).

Further, in some embodiments herein, the word "gaming" is used interchangeably with "gambling."

Furthermore, for purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Although FIG. 1 describes some embodiments, the following sections describe many other features and embodiments.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 2:
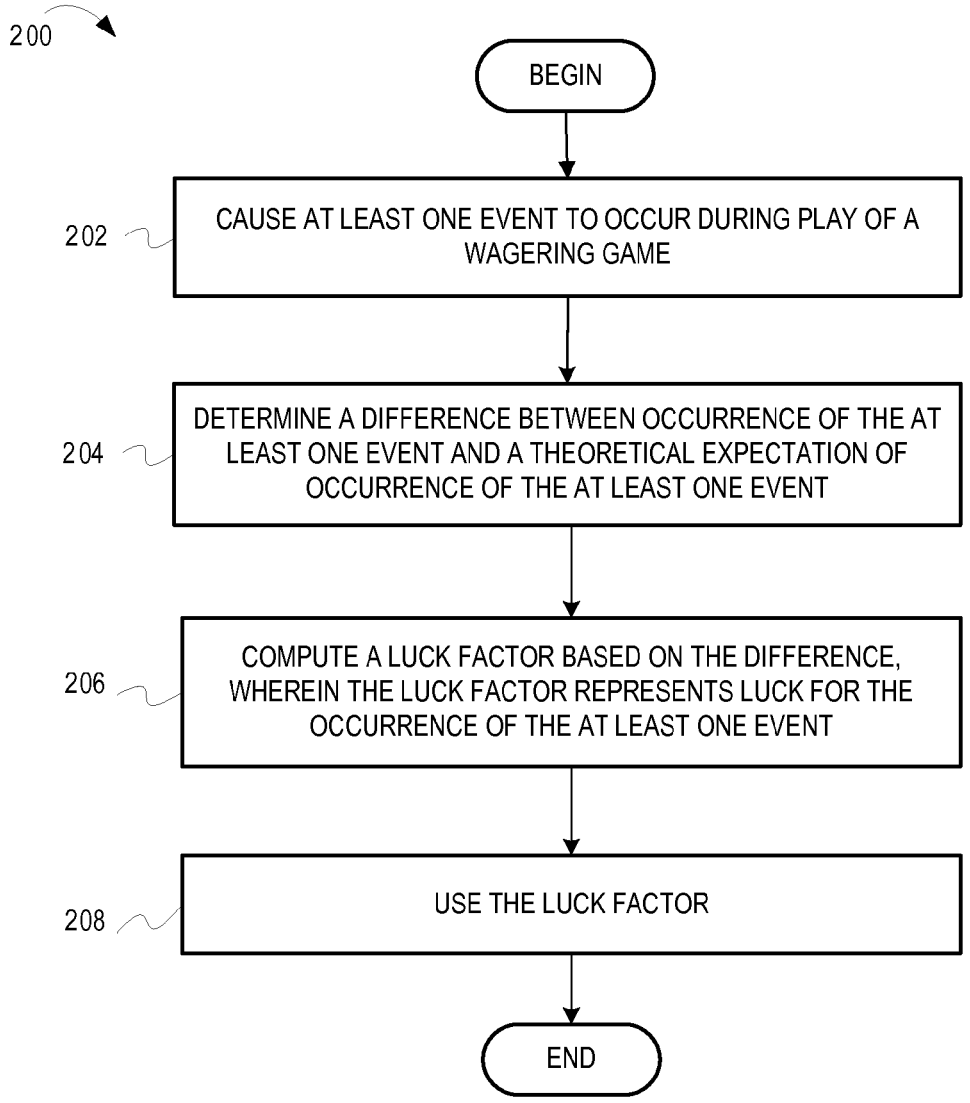
FIG. 2 is a flow diagram 200 illustrating computing wagering game luck, according to some embodiments.
Figure 3:
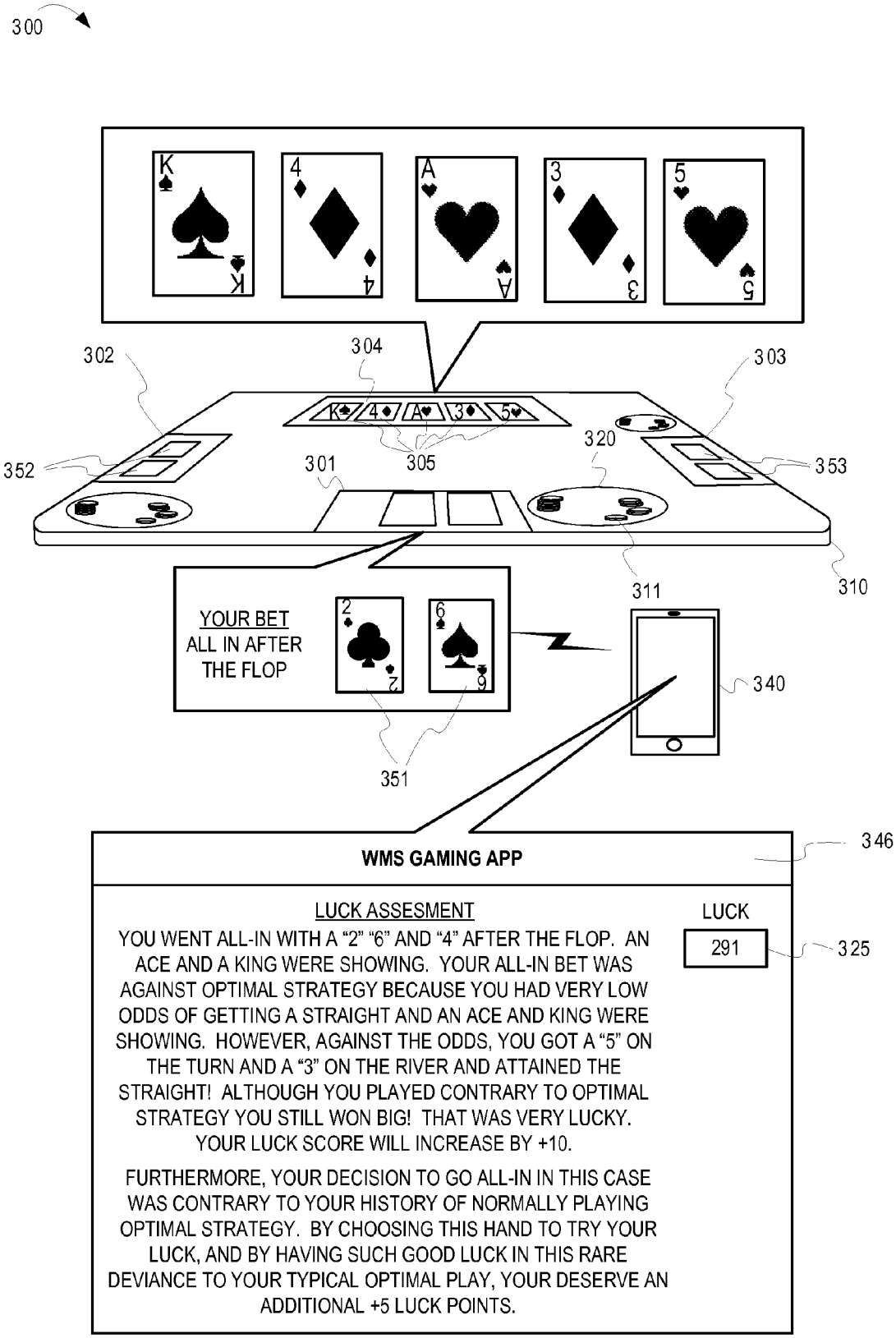
FIG. 3 is an illustration of computing wagering game luck in a card game, according to some embodiments.
Figure 4:
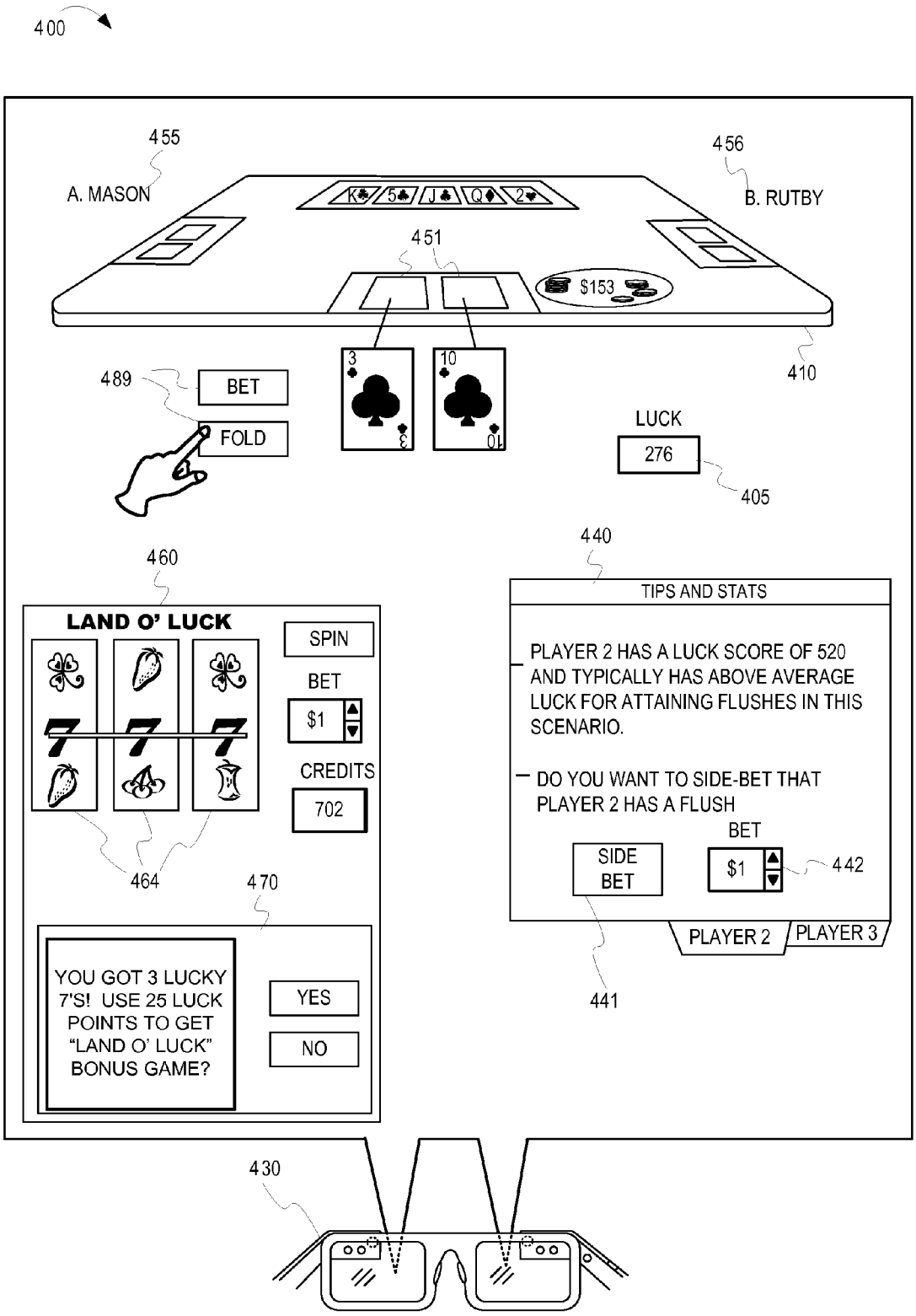
FIG. 4 is an illustration of computing and using wagering game luck, according to some embodiments.
Figure 5:
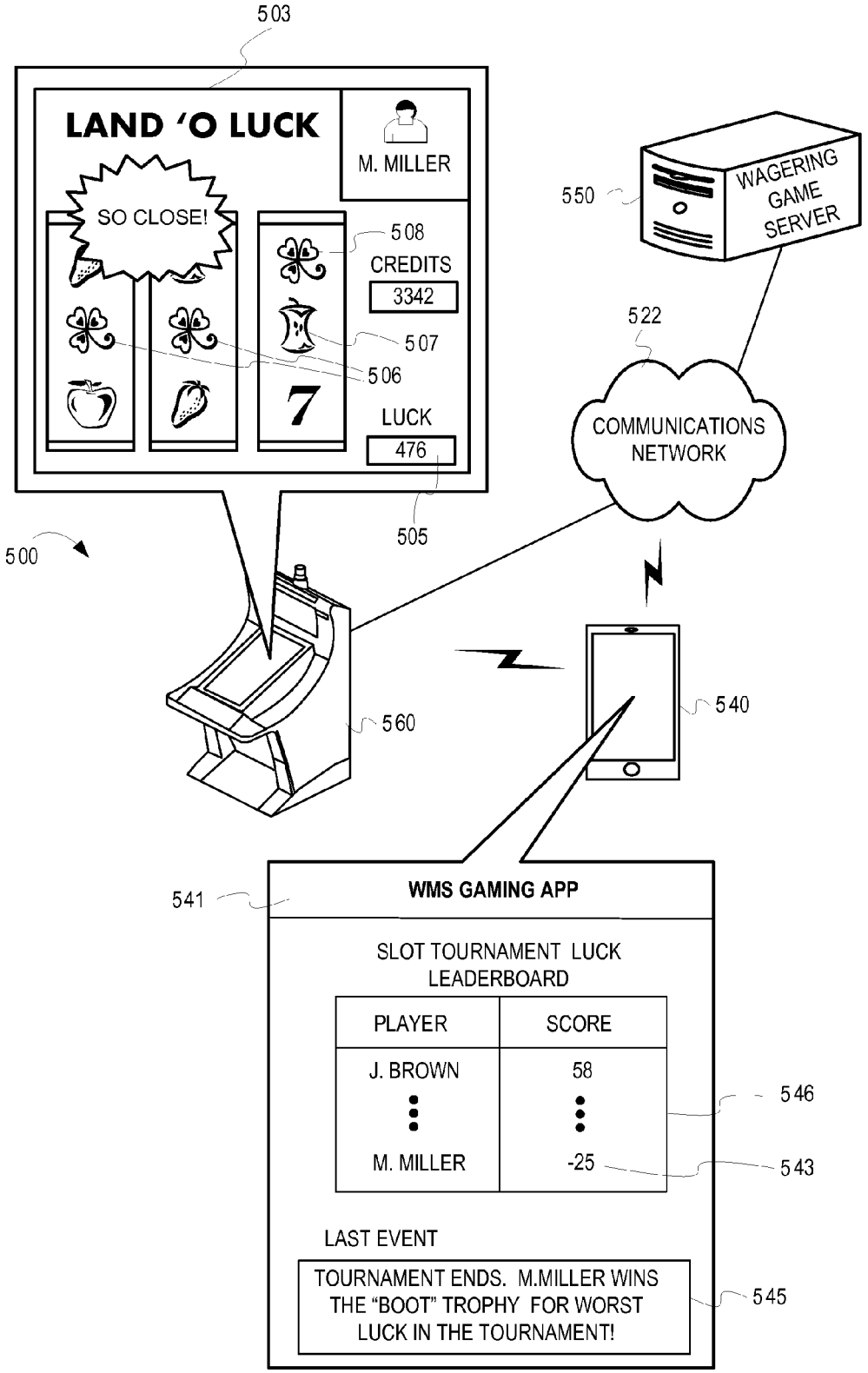
FIG. 5 is an illustration of computing and using wagering game luck, according to some embodiments.

FIG. 2 is a flow diagram ("flow") 200 illustrating computing wagering game luck, according to some embodiments. FIGS. 3, 4, and 5 are conceptual diagrams that help illustrate the flow of FIG. 2, according to some embodiments. This description will present FIG. 2 in concert with FIGS. 3, 4 and 5 and will also refer back to FIG. 1.

In FIG. 2, the flow 200 begins at processing block 202, where a wagering game system ("system") causes at least one event to occur during play of a wagering game. For brevity, the phrase "at least one event" may be referred to as "event(s)" because the at least one event can be one or more events. The system can cause a specific type or types of the event(s) (e.g., winning events, losing events, primary game events, secondary game events, outcome events, non-outcome events, slot game events, card game events, group game events, individual game events, etc.). In some embodiments, the system can generate the event(s) using a random number (e.g., generate a wagering game outcome using a random number as explained in FIG. 1). In some embodiments, the system can cause a combination of the event(s) (e.g., a winning outcome in a primary game and a winning outcome in a bonus game). In some embodiments, the system can cause a sequence of the event(s) (e.g., a series of consecutive winning outcomes). In some embodiments, the system causes the event(s) at a specific period (e.g., at the beginning of a gaming session, at an end of a gaming session, within a time or date, etc.).

The flow 200 continues at processing block 204, where the system determines a difference between occurrence of the at least one event and a theoretical expectation of occurrence associated with the at least one event. The system can determine a theoretical expectation of occurrence for the event(s) by detecting a typical, or theoretical way the event(s) would be expected to occur. For example, the system can detect one or more characteristics related to occurrence of the event(s) during a wagering game session. The system can analyze the characteristics of the occurrence of the event(s), such as information about a probability of occurrence of the event(s), a frequency of occurrence of the event(s), a sequence of occurrence of the event(s), a level of occurrence of the event(s), a timing of occurrence of the event(s), an order of occurrence of the event(s), an occurrence of a type of the event(s), a money value of the event(s), an intensity of presentation of the event(s), and a duration of presentation of the of the event(s). The characteristics can also include information about the context or situation in which the event(s) occurred, information about a wagering game session for which the event(s) occurred, information about a player or player account associated with a wagering game session in which the of the event(s) occurred, information about an environment or venue in which the of the event(s) occurred, etc. Based on an analysis of the characteristics and information associated with the occurrence of the event(s), the system can determine what the expectation of occurrence would be for the event(s). FIG. 1 illustrated an example where the system 100 determines that the occurrence of the winning outcome indicated by the three shamrock symbols 106 had a probability of occurrence less 0.02%, which is less than 1 out of 5000. Furthermore, the system 100 determines that the occurrence of the winning outcome is a second consecutive winning outcome (i.e., two wins in a row) during the wagering game session conducted via the wagering game machine 160. The system 100 references the luck rules 112, which indicate criteria 113 associated with corresponding luck parameters 114 that are used to compute a luck score. The criteria 113 can include specific conditions related to the characteristic of the event(s) that occur during a wagering game session associated with the wagering game 103, the wagering game machine 106, the wagering game server 150, the player account 171, or other elements of the system 100. The luck rules 112 include an indication of the criterion 117, which specifies that consecutive wins in a wagering game 103 should qualify for a computation of a luck score. In some embodiments, the luck rules 112 do not include all possible conditions or characteristics related to all possible events, only those that qualify for application of the luck parameters 114.

The following paragraphs describe some examples of how the system determines a difference between occurrence of the event(s) and a theoretical expectation of occurrence associated with the event(s).

Probability of Occurrence of the Event(s).

In some embodiments, the system determines that an occurrence of the event(s) varies from an expected probability of occurrence of the event(s) in the wagering game. For example, in FIG. 1, the system 100 determines that only about one in every five spins of the wagering game 103 results in a winning outcome. The system 100 can refer to luck rules 112, which specify the probabilities of experiencing a winning outcome for the wagering game 103, such as criterion 115. For instance, for the wagering game 103, a probability of experiencing a winning outcome may be approximately ⅕, or 20%, and the probability of experiencing a losing outcome is approximately ⅘, or 80%. Thus, the theoretical occurrence of any given spin is expected to be a non-winning event. Because the outcome associated with the three shamrock symbols 106 for the wagering game 103 is a winning outcome, the system 100 determines that the actual outcome, as a winning outcome, is not expected (e.g., is less likely to occur than an expected outcome of a non-win). Because the system 100 determines that the actual outcome is different from an expected outcome, the system 100 determines that it needs to compute a luck factor (e.g., as described at processing block 206 below).

Some of the probabilities indicated in the luck rules 112 are probabilities that are not used for, or specified in, game rules, pay tables, or any other configured settings for the wagering game 103. For example, the game rules may not specify theoretical probabilities or odds of winning versus non-winning events. In other example, however, the system 100 may utilize information from game rules, pay tables, or other configured settings for the wagering game 103. For example, the following is an example of using some information from a pay table for the wagering game 103 to determine that an occurrence of an event varies from an expected probability of occurrence of the event. The system 100 determines that for all potential winning outcomes indicated in a pay table for the wagering game 103, half of the potential winning outcomes indicated in the pay table have a payout of less than a scale factor of 5 times the bet amount. The other half of the potential winning outcomes indicated in the pay table have payouts have a scale factor of more than 5 times the bet amount. Therefore, in this example, a winning outcome for the wagering game 103 could be expected to have approximately a scale factor of 5 times the bet value, or in other words has a theoretical occurrence of a scale factor of approximately 5 times the bet. In FIG. 1, however, the winning outcome associated with the three shamrock symbols 106 is rare, and amongst those of the potential winning outcomes that have a scale factor much higher than 5 times the bet amount. Because the system 100 determines that the actual outcome (i.e., the actual payout being higher than a scale factor of 5) is different from an expected outcome (i.e., the scale factor of approximately 5), the system 100 determines that it needs to compute a luck factor (e.g., as described at processing block 206 below).

Frequency of Occurrence of the Event(s).

In some embodiments, the system determines that a frequency of occurrence of the event(s) varies from an expected frequency of occurrence of the event(s) during the wagering game session, (e.g., detecting that an occurrence of a consecutive sequence of the event(s) does not normally occur in the consecutive sequence, such as hitting the event twice in a row). For example, in FIG. 1, the system 100 determines that the occurrence of the winning outcome is a second consecutive winning outcome (i.e., two wins in a row) during a wagering game session. Furthermore, game rules, or other configuration settings of the wagering game 103, may not include any expectations or odds regarding sequential winning events. The luck rules 112, however, do include information regarding theoretical, or expected, occurrences of consecutive winning outcomes. For example, the luck rules 112 indicate criterion 117 described previously. A frequency of occurrence of events can apply to hit rates associated with the wagering game 103. The system 100 can access a history of hit rates stored on the wagering game machine 160, the wagering game server 150, the account server 170, or elsewhere, and compare them to theoretical hit rates stored in the luck rules 112.

Level of Occurrence of the Event(s) in a Time Period.

In some embodiments, the system determines that an amount or level of occurrence of the event(s) within a given period varies from an expected amount of occurrence of the event(s) within the given period. For example, the system detects that a specific winning outcome occurs twice within two minutes. The system can determine, based on a given rate of play, that a typical expectation for the reoccurrence of the winning outcome may be much more than two minutes apart. In another example, the system detects amounts of credits that are won or lost, or a count of wins and losses, within a given time period and compares them to a typical amounts of wins or losses or wins, or a typical count of wins or losses for that period.

Position of Symbols of the Event(s).

In some embodiments, the system determines that a position of symbols within the wagering game varies from an expected/typical position of symbols. For example, in FIG. 1, the symbols 106 line up in a middle row of an array of symbols, along the pay line 107. The payline 107 is along a middle row of an array of slot reel symbols. The middle row is a default row along which to determine that a winning configuration of symbols align. However, the wagering game 103 may provide an option to select more than one payline. In other words, when an additional payline is selected, a single spin of the reels 102 provides for another possible way to align up a winning configuration (e.g., along a top row of the array, along a bottom row of an array, in a non-uniform alignment, etc.). If the more than one payline is selected (for which an additional bet can be placed during a single spin of the reels 102), the system 100 tracks alignment of specific symbols in more than just the middle row of the array of symbols. If, however, the shamrock symbols 106 were to have aligned in a top row of the array of symbols, and the player associated with the wagering game 103 had only selected one payline (i.e., the middle row of the array), then the system 100 could consider the alignment of the potentially winning combination of shamrock symbols 106 other than in the middle row to be bad luck. In other words, to have three potentially winning symbols align anywhere in the array of displayed reel symbols, a theoretical expectation may be that they align to cause a win (e.g., align along a payline), and when they do not, the actual result varies from the expected result, which the system 100 can utilize as a criteria for bad luck.

Type of Occurrence of the Event(s).

In some embodiments, the system determines that occurrence of a type or types of the event(s) varies from an expected occurrence of the type or types within the wagering game. For example, the system can detect winning events versus losing events, primary game events versus secondary game events, outcome events versus non-outcome events, group game events versus individual game events, random events versus non-random events, monetary versus non-monetary events, etc. Further, the system can detect various types of events for various types of different wagering games. The following paragraphs include some example events that the system can detect during a slot type of wagering game. The following examples not exhaustive.

Streaks of hits.

Streaks of no hits (e.g., playing unusually long without hitting a feature).

Triggering a bonus on a first or last spin of a session or bankroll (i.e., when a session balance indicated in a credit meter has gone below an ability to make an additional wager without additional funds being added to a session balance).

Triggering a bonus or other feature on back-to-back spins.

Events that occur within bonuses (e.g., getting the top pick on a first pick of a picking game, or getting a collect symbol or "pooper" on the first pick or earlier than expected).

Winning multiple progressives on a same spin or on successive spins.

Free-spin retriggers (i.e., retriggering a free-spin bonus while within a free-spin bonus).

Getting a large number of free spins to be played in a bonus, then getting no wins, or a low amount of wins, in that bonus.

The next person who wins on a first spin of a session on a machine after a previous person quit playing on the machine (e.g., as an indication that the next person took some of the previous person's luck).

The following paragraphs are some example events that the system can detect during a card type of wagering game. The following examples not exhaustive.

Streaks of hits.

Streaks of no hits.

Winning on a sub-optimal outcome.

Getting card-hand outcomes in succession.

Getting a winning hand on an initial deal.

Playing against an optimal strategy and getting a win.

In multi-hand poker getting no, or a low number of, winning hands after a first deal that likely should produce a relatively high number of wins. In multi-hand poker, after an initial deal, whatever hand is dealt for the initial deal is copied to multiple other hands for the player. If, for instance, the first hand had four to a flush (i.e., four suited cards) then approximately one fourth of the other hands should expect to attain a flush after a first draw. However, if less than approximately one fourth of the hands results in a flush after the first draw, the system could consider that result to be unlucky. The reverse could be true if more than approximately one fourth of the hands resulted in a flush after the first draw.

The following are some example events that the system can detect during other types of wagering games. The following examples not exhaustive.

For bingo and lottery types of games, the system can track whether a multiple number of cards fail to obtain a winning value.

For lottery games, the system can detect back-to-back lottery wins.

Timing, Order, or Combination of the Event(s).

In some embodiments, the system determines that a timing, order, or combination of occurrence of the event(s) varies from a typical timing or order of occurrence for the event(s). For example, the system can determine that a winning outcome that occurs on a first or last play (e.g., spin, hand, etc.) of a wagering game session or bankroll does not normally occur and, therefore indicates an opportunity to compute a luck factor.

In another example, the system can determine that a "near win," (e.g., the last symbol missed in FIG. 1 regarding criterion 119) occurs.

In another example, the system can determine whether specific events happen between different games presented during the wagering game session, such as when an event in a primary game and an event in a bonus game are related. For example, the system can determine whether a free-spin bonus is triggered in a primary game. A free-spin bonus is a bonus game that provides extra free spins as a result of a triggering event in the primary game. For instance, if a specific number of symbols, or combination of symbols, appears during the primary game, in a specific configuration, then the primary game launches a bonus game feature that provides a specific number of free spins. Free spins are spins of a slot game that can pay out an award without having to place a bet. The bonus game feature usually has some similarity or connection to the primary game, such as a similar theme, a shared pay table, etc. If the free-spin bonus has similar symbols as the primary game, then a random spin of reels in the bonus game can result in the same outcome that caused the free-spin bonus to be triggered. If, during the free-spin bonus, an event retriggers the free-spin bonus, then the system can consider the bonus retrigger to be more lucky than just triggering the bonus twice from the primary game.

In some embodiments, the system can detect whether an event occurs in combination with another event. For instance, when more than one of the criteria 113 apply in combination, then the system 100 can add an extra luck parameter because of the combination occurred at the same time as opposed to occurring at separate times (e.g., an additional 10 luck points are awarded because the combination of criterion 115 and 117 occurred on one spin). In some cases, the combination may be in a series. For instance, getting a combination of repeating reel-stop configurations for two consecutive wins (e.g., each of the consecutive wins have the same reel-stop configuration) can be considered more lucky than two consecutive wins with separate reel-stop configurations because the expectation is that reel-stop configurations are typically different for consecutive spins.

Amount of Winnings Associated with the Event(s).

In some embodiments, the system determines that an amount of winnings won during the wagering game varies from a typical amount of winnings. For example, a large win value, or an accumulated winning value over a short period of time can indicate good luck.

Volatility of Payout Associated with the Event(s).

In some embodiments, the system determines that a volatility of a payout varies from a theoretical volatility for the wagering game. For example, over a period of plays, the system detects that a wagering game pays out win values that are outside a typical range of pay outs (e.g., a typical range may include a scale factor of between 5 to 10 times the bet value, but during one gaming session the system detects an unusually high scale factor payout for wins).

Playing Strategy Associated with Event(s).

In some embodiments, the system determines that a playing strategy for the wagering game varies from an optimal playing strategy for the wagering game. The playing strategy followed by a player during the wagering game may instead make an event unlikely to occur (e.g., the player's strategy may make winning unlikely). However, the system can determine that the event occurs despite being unlikely to occur based on the playing strategy for the wagering game (e.g., winning at poker despite having played against the optimal strategy). FIG. 3 illustrates an example wagering game system ("system") 300 with a wagering game table ("table") 310 that presents a community hand 304, such as in a game of Texas Hold 'Em Poker. The community hand 304 includes cards 305 with ranks and suits (e.g., King of Spades, Four of Diamonds, Ace of Hearts, Three of Diamonds, and Five of Hearts). The table 310 includes several player stations 301, 302, and 303. Player station 301 includes a first set of hole cards (i.e., cards 351) that a first player can utilize to compete against other players. Player station 302 includes a second set of hole cards (i.e., cards 352) that a second player can use to compete against other players. Player station 303 includes a third set of hole cards (i.e., cards 353) that a third player uses to compete against other players. Each of the players can utilize their own set of cards as well as the cards 305 in the community hand 304 to generate the best five-card hand. Each of the player stations 301, 302, and 303 can include sections 320 for chips 311, or other betting instruments. The system 300 also includes one or more displays to present information about the wagering game. For instance, the player stations 301, 302, and 303 can present the sets of cards 351, 352, and 353 via displays. The system 300 can also integrate with peripheral devices and/or personal mobile devices (e.g., handheld devices, table computers, smartphones, etc.). For example, the first player may utilize a mobile device 340 that runs a wagering game application 346. The mobile device 340 integrates (e.g. communicates wirelessly) with a wagering game controller in the system 300, such via an application of the wagering game table 310 or a wagering game server. In some embodiments, the system 300 detects a playing strategy made by the first player that appears to be contrary to an optimal playing strategy. For example, after the system 300 dealt the first three of the community cards 305 (the "flop"), the flop cards included the King of Spades, the Four of Diamonds, and the Ace of Hearts. The cards 351 included the Two of Clubs and the Six of Spades. The combination of the cards 351 and the flop cards, therefore, only included one Club card, two Spade cards, one Diamond card, and a Heart card. There would be no chance of the first player obtaining a flush because the next two phases of dealing the community hand 304 (i.e., a "river" card and a "turn" card), even if both were the same suit, would not produce a five-card hand with five of the same suit. Furthermore, the flop cards included a King and an Ace, compared to the value of the cards 351 (a Six and a Two). There would have been a chance that either the second player or the third player had a King or an Ace and, therefore, would have made a very high pair. Furthermore, because the first player had gaps in a potential straight (i.e., the Two card value was separated from the Four value by one card and the Four value was separate by the Six value by one card). Thus, to make a straight, the player would have to get exactly a Three card value and a Five card value on the remaining portion of the game (i.e., on the river and the turn). Therefore, optimal strategy for this particular hand would have been for the first player either to fold (if faced with a high competing wager) or to play cautiously (e.g., making standard bets or checking). However, the first player played a non-optimal strategy by playing aggressively, and going all-in after the flop with very little chance of making a strong hand. As the game continued, the river and turn cards, despite the odds, produced a Three of Diamonds and a Five of Hearts, resulting in a very strong hand for the first player (a straight of Two, Three, Four, Five and Six). The first player would then very likely win. The system 300 detects that the first player's non-optimal play should very likely have resulted in losing all of his chips 311, and losing the Poker game. However, the system 300 determines that the first player's non-optimal playing strategy resulted in a very strong hand and/or winning outcome against the odds, and therefore, merited luck points. Thus, the application 346 associated with mobile device 340, increases a luck score presented in a luck meter 325 and also presents an explanation of why the luck points were awarded.

History of Game Play Associated with the Event(s).

In some embodiments, the system determines that occurrence of the event(s) varies from a history of game play. The system can track the game play history over time (e.g., analyze play events over specific time periods, analyze a specific number of spins or plays, etc.) and compare the occurrence of the event(s) to a compilation of events stored in the game play history (e.g., stored in a database). The system uses the game play history as context for assessing the event(s). In some examples, the game play history includes a player's last number of spins (e.g., last two spins), a player's entire gaming session, a history of events for day, week, or other time period, a history of play in given situations, a history of a player's playing strategy over time, etc.

In some embodiments, the system can analyze the history of wagering game play for a player account associated with the wagering game, compute a theoretical expectation of occurrence for the event(s) based on the history of wagering game play, and evaluate an occurrence of the event(s) (during a current game play) against the theoretical expectation of occurrence. The system can determine theoretical expectation based on some, all, or specific parts of the gaming history, thus providing different contexts in which to ascertain luck. For example, the system can detect that a player is very far behind on a certain hand and would normally be expected to lose. However, if the player very quickly, and unexpectedly, catches up, the system would consider that event to qualify for a luck computation.

In one example, referring again to FIG. 3, a first player received luck points for playing a non-optimal strategy and winning despite great odds. However, the system 300 can further detect that the player played the non-optimal strategy contrary to a history of playing according to optimal strategy. Thus, the instance where the player deviated from his normal playing strategy to take a chance at winning big on a weak initial hand is another indication of where the system 300 can reward additional luck points.

In some embodiments, the system compares actual values for the event to a game play history of other player accounts. In other words, the system can utilize expected occurrences of the event based on data from multiple player accounts, not only from one player account. For example, the system can detect an average frequency of occurrence of an event (e.g., average wins or losses) for all players in a gaming venue over a past time period and use the average frequency of occurrence as a baseline against which to compare the actual occurrences of the event associated with a specific player.

Referring again to FIG. 2, the flow 200 continues at processing block 206, where the system computes a luck factor based on the difference between the occurrence of the at least one event and the theoretical expectation of occurrence of the at least one event. The luck factor represents luck for the occurrence of the at least one event. The luck factor can be associated with (e.g., attributed to) a player, a player account, a wagering game machine, a wagering game session, a wagering game, etc.

In some embodiments, the system determines a difference between the occurrence of the event(s) and the theoretical expectation of occurrence associated with the event(s) by accessing a set of luck rules that indicate the theoretical expectation of occurrence, as similarly described in FIG. 1. In FIG. 1, for instance, the system 100 determined whether the event met certain criteria 113. When the event met one or more of the criteria 113, the system 100 applied certain luck parameters 114 that corresponded to specific ones of the criteria 113 to compute a luck score.

In some embodiments, the system utilizes mathematical factors from game rules (e.g., pay table probabilities). For example, in a wagering game, the occurrence of a royal flush may be built into the game rules as a payout event if it occurs. If a royal flush occurs at any given game play, a player account will likely win an amount based on the pay table. The system can, in response, cause a luck factor to increase by a high amount (e.g., 45 points) because it is a very luck event. In another example, as described in FIG. 1, the criterion 115 is related to a probability of an event (e.g., a winning outcome) that is indicated in a pay table for the wagering game 103.

However, in some embodiments, the system utilizes information separate from mathematical factors from game rules to compute luck factors. For example, luck rules can include criteria that are based on how any events would normally be expected to occur besides just events indicated in a pay table.

In some embodiments, luck rules can include criteria related to how an event occurred, and the context of the occurrence, not just that the event occurred. For example, game events have a certain probability of occurrence within a wagering game (e.g., specific reel-stop configurations for reel games, specific card deals for card games, etc.) based on the odds indicated in a pay table for the game. However, a pay table typically indicates odds of occurrence for only one given game play (e.g., for one spin of the reels on one bet, for one given card hand, etc.). The pay table typically does not indicate odds of that game event occurring more than once within a given time period or within a certain number of plays. For example, a low-probability reel-stop configuration or low-probability card hand (e.g., the royal flush) is expected to occur rarely (e.g., usually only once in every X number of spins or card hands) because the odds of occurrence are so rare for any given one game play. The luck rules, however, could indicate odds of occurrences over time, and therefore odds of occurrences of multiple occurrences of the low-probability reel-stop configuration or low-probability card hand over any given time period. Thus, if the low-probability reel-stop configuration or card hand (e.g., the royal flush) occurs consecutively, or within a given number of spins or dealt hands from each other much less than the X number of spins or card hands, then that equates to an increase in luck factor. For example, previously it was described that if a player were to get a royal flush, then the player's luck factor would increase by a given amount (e.g., +45 points) because obtaining a royal flush is a very luck event. However, if the player gets two royal flushes during the same game session (e.g., within 2 hours of each other or within 100 hands played, then the increase to the player's luck factor on upon receiving the second royal flush would be much greater than twice the given amount received for a single occurrence. For instance, instead of just providing +45 points in addition to the first +45 points, the player's luck factor would increase by an additional +100 points (or some other number greater than just an additional +45 points) to indicate that the second occurrence of the royal flush, in relation to the first royal flush, is much luckier.

In another similar example, for a Poker game, a player may be dealt five poker cards and, during the wager cycle, the player is allowed to throw away up to all five cards and replace all five again during a replacement deal ("re-deal"). According to game rules, if a player threw away one card and then on the re-deal got the one card needed to obtain a royal flush, the game would payout the same as if the player had thrown away four cards and then on the re-deal got four new cards needed to obtain the royal flush. However, the luck rules may indicate that it is more lucky to throw away four cards and then get the royal flush on the re-deal of four consecutive cards than it would be to throw away only one card and then get the royal flush on the re-deal. Thus, the system would provide a luck factor increase of +45 for the occurrence of the royal flush, and an additional luck factor increase (e.g., an additional +30 points) for getting the royal flush by with a four card re-deal. The luck factor increase could be proportional to the number of cards re-dealt during the wager cycle.

In some embodiments, the system detects a difference between a player streak and a game hit rate and computes a luck factor accordingly. For example, the system may determine, based on luck rules, that for a three-reel slot game that has a 10% hit rate (i.e., 10% chance that any given game play will result in a pay table outcome), to get a streak of seven hits in a row is much luckier than getting a streak of seven hits in a row for a game with a 70% hit rate.

In some embodiments, the system can determine to compute a player's luck factor as bad luck if a player's hit rate is less than a game's hit rate. On the other hand, if a player's hit rate is greater than that of the game's hit rate the system can compute the player's luck factor as good luck.

In some embodiments, the system computes a luck factor by increasing a value of the luck according to events that appear to be advantageous or numerically superior to a theoretical expectation of occurrence (i.e., when a value associated with an actual event is greater than a value for the theoretical expectation of occurrence). On the other hand, the system can decrease a value for the luck factor when events are less advantageous or numerically inferior to the theoretical expectation of occurrence or theoretical expectation of occurrence (e.g., when a value associated with an actual event is greater than a value for the theoretical expectation of occurrence). For example, as in FIG. 1, the system 100 increases the luck score 124 when a low-probability, high payout occurred (i.e., that had a probability less than 1/5000) or when a sequence of wins occurred. On the other hands, the system 100 decreases the luck score 124 for a near-win.

In some embodiments, the system generates differing degrees of luck factors. In some embodiments, the system generates degrees of luck factors based on degrees of occurrences of events and/or degrees to which the event deviates, or varies, from an expected occurrence for the event. For example, when a player deviates once from an optimal playing strategy and wins, the system may compute a luck factor to a first degree. However, if a player plays contrary to an optimal strategy several times and the player wins for most of those several times, the system can compute a higher degree of luck. In other words, if a player wins once while playing against optimal strategy, the player may be considered lucky. However, if the player wins consistently while playing against the optimal strategy, the player is considered more lucky. In another example, the system can generate degrees of value for the luck factor proportional to degrees of probability of occurrence for the events.

In some embodiments, the system generates a value for the luck factor as an integer over time. In some embodiments, the system generates a value for the luck factor as a running balance. In some embodiments, the system computes luck as textual descriptions (e.g., "Lucky," "Very Lucky," "Exceptionally Lucky," etc.).

Referring again to FIG. 2, the flow 200 continues at processing block 208, where the system uses the luck factor. The system can use the luck factor in various ways. For example, when a value associated with the luck factor (e.g., a luck score) exceeds a given threshold level or increases a certain amount within a given time period, the system can cause one or more additional events to occur, provide specific content, perform additional functions, award certain prizes, etc. The following are some examples of using a luck factor according to some embodiments.

Presenting the Luck Factor.

In some embodiments, the system presents the luck factor during the wagering game via a display (e.g., via a luck meter that increases or decreases according to luck computations), via speakers, via peripheral devices, via a mobile device, or in other ways (e.g., via email, via an electronic text message, via a social network communication, via a blog post, via a leaderboard, etc.) In some embodiments, the system indicates players who are making bets on sports events and shows their luck scores so that other players can mirror bets of the luckiest betters. In some embodiments, the system notifies a casino pit-boss or other administrator so that the casino can provide appropriate compensations. In some embodiments, the system portrays luck via a secondary economy. In some embodiments, the system display a luck factor value as it relates to a player, a group of players, a machine, a group of machines, etc.

Persisting Luck with a Player Account and Between Gaming Devices.

In some embodiments, the system can cause luck values to persist in a player account. In some embodiments, the luck values can follow a player from machine to machine as the player moves from machine to machine. In some embodiments, the system can cause a pay table to increase based on the luck score as the player moves between machines. When the player leaves a machine, a "heat" level can remain with the machine for a given period of time (e.g., the luck glows for a while on the machine after the player leaves). In some embodiments, when a player joins a bank, the entire bank of machines can benefit from the player's luck factor (e.g., the entire bank bumps up to the higher pay table, the bank utilizes a new graphic, etc.). In some embodiments, the system can show luck "heat" levels via emotive lighting, environmental effects, exclusive content, etc.

Selecting or Generating Content Using a Luck Factor.

In some embodiments, the system can automatically (e.g., without user input) select, generate, or modify wagering game content, additional features, and/or special effects based on the luck factor (e.g., redeeming the luck factor for a bonus game, providing a presentation of a specific light show using emotive lighting, providing a bonus game, etc.). In some embodiments, the system can automatically increase a pay table (swap or upgrade the pay table) based on the level of luck. In some embodiments, the system can automatically increase an intensity of an anticipatory effect based on luck (e.g., for a re-trigger bonus, the system can increase the intensity of lighting effects or sound levels from a previously triggered bonus). In some embodiments, the system can automatically provide additional features or content that can relate directly to game play (e.g., add or change symbols on a slot reel, allow selection of symbols, add a new bonus game, etc.). In other examples, the system can automatically provide additional features or content that may not be directly related to game play (e.g., allow zooming, add background graphics, cause a seat to move, activate a top box, etc.). Furthermore, the system can automatically set a value for a feature based on a luck factor (e.g., an amount of winnings for a bonus game can be set proportional to an amount of luck points attained prior to the presentation of the feature).

Using a Luck Factor Value to Purchase Additional Wagering Game Content or Features.

In some embodiments, the system can redeem a quantifiable amount of a luck factor to attain additional content. For example, the system can automatically use, or detect a manual request to redeem, a number of luck points from a player account before additional content is presented. The value of the number of luck points required can be based on levels of luck attained by the player account. In some embodiments, the system can further cause a value for the content to be based on a value for the luck factor (e.g., generate a bonus game where the amount of credits winnable in the bonus game is based on how many). FIG. 4 illustrates an example of a wagering game system ("system") 400 that can select and present specific content based on redemption of luck points. In FIG. 4, the system 400 includes a wagering game table 410 similar to the wagering game table 310 described in FIG. 3. The system 400 can also include gaming eyewear 430 used to view wagering game content, such as some, or all, of the content presented via the wagering game table 410 and additional content, such as game controls 489, a luck meter 405, help tips and statistics 440 related to a wagering game, information about additional players (e.g., an indication 455 about a second player "A. Mason" or an indication 456 of a third player "B. Rutby"), and a secondary wagering game 460. The secondary wagering game 460 includes reels 464 that include symbols that can arrange into reel-stop configurations related to wagering game outcomes. In FIG. 4, the secondary wagering game 460 experiences a winning outcome (e.g., three "lucky 7" symbols aligned in a payline). As a result, the system 400 presents a console 470 by which a player can specify an option to use twenty-five of the luck points indicated in the luck meter 405 to play a bonus game.

Comparison of Luck Factors.

In some embodiments, the system can compare a luck factor for one player account to an additional luck factor for an additional player account and recommend a playing strategy against the additional player account based on the comparing. For example, in FIG. 4, the system 400 presents, within the help tips and statistics 440, information about a competing player's luck factor and how much luck the competing player has in a given situation.

Using Luck Factors for Side Bets.

In some embodiments, the system computes a side-bet based on a luck factor (e.g., betting on another player's luck). In some embodiments, the system can place side-bets on how well one player believes another player will perform based on, or according to, their luck factor. For example, the system can provide betting options for a player to place a wager that an additional player's luck factor will rise or fall within an upcoming time period. In some embodiments, the player can side bet on whether that player's luck factor will be greater than or less than another player's luck factor. The system can provide prizes proportional to how close the player's guess was. In FIG. 4, the help tips and statistics 440 includes a side-bet control 441 and a betting meter 442 to specify an amount to side bet on whether a specific player has a specific card hand.

Using the Luck Factor as an Outcome for an Additional Wagering Game.

In some embodiments, the system can use a luck factor as a secondary gaming outcome that has payback attached to it (e.g., a leaderboard that pays out for certain places on the leaderboard).

Ranking a Player Account in a Tournament Based on a Luck Factor.

For example, the system can determine which player in a tournament is luckiest, unluckiest, etc. The system can determine a variance of luck performance in one tournament compared to a player's overall luck over a number of tournaments or other player's luck. The system can use the information to indicate how one player's luck performance in a tournament was luckier or unluckier than in other tournaments. In some embodiments, the system uses the information to evaluate a player's luck performance against other players luck performance. FIG. 5 illustrate an example wagering game system ("system") 500. The system 500 includes a wagering game machine 560 connected to a wagering game server 550 and a mobile device 540 connected via a communications network 522. The wagering game machine 560 presents a wagering game 503 that a player (i.e., the player "M. Miller") plays via a player account. During game play, the player experiences a near-win where two symbols 506 align in a middle row of an array of symbols, and a third symbol 508, which would have completed a winning outcome, does not align in the middle row. Instead, symbol 507 aligns in the middle row, causing the gaming outcome to be a losing outcome. The system 500 can determine a negative luck score for the near-win event and subtract the amount from a luck score 505. The luck score 505 applies to the player account's overall luck score as tracked over a very long period. During the period of a wagering game tournament, however, the system 500 tracks a separate luck factor 543 for the player only during the last number of spins related to the wagering game tournament. The system 500 presents a leaderboard 546 of luck scores for various players who are participating in the wagering game tournament. The leaderboard 546 can be presented via an application 541 of the mobile device 540. Furthermore, when the wagering game tournament ends, a tournament controller (e.g., the wagering game server 550) provides a reward (e.g., the "boot" trophy) to the player (e.g., M. Miller) for having the lowest luck score in the tournament. The application 541 presents a message 545 that notifies the player.

Determine a Degree of Skill for a Player Based on a Luck Score.

In some embodiments, the system can assess luck for a player based on a player's history of playing according to, or against, optimal strategy. For example, the system can detect that a player consistently wins even though a luck score is very low. In other words, the system detects that the player wins despite having bad luck, which can be interpreted that the player has skill at playing optimal strategy. Thus, the luck score, in combination with a winning percentage, can be an indication of a player's skill. The system, therefore, can indicate that the player has great skill because winning despite having a low luck score indicates that the player understands, and played, optimal strategy more effectively to overcome the bad luck.

Providing a Prize or Reward Based on a Value of the Luck Factor.

For example, the system can provide a first ranking for a player in a tournament based on luck and provide a second ranking for the player based on winning outcomes during the tournament. The system can evaluate the first ranking against the second ranking to generate an overall ranking in the tournament (e.g., subtract the first ranking from the second ranking) and whoever has the highest difference gets a luck-based prize. In some embodiments, the system can provide a consolation prize for bad luck. For example, the system can provide a bad-beat prize or bad-luck tournament jackpot consolation prize for being the unluckiest player in a tournament. In some embodiments, the system can provide an automatic rebuy into another tournament if the player was the unluckiest player in previous tournament. In some embodiments, the system can offer a seat at a final table for the player who was the unluckiest player.

In some embodiments, the system can provide trophies or virtual assets, provide achievements, increase or modify status, and so forth, based on luck factors.

In some embodiments, a tournament can be entirely based on luck factors. In other words, the luck factor can be used entirely to determine a winner of a tournament, not win amounts.

Similar to the slot tournament, the system can provide entries to a sweepstakes by either detecting that a player finishing at a set "luck level" based on a particular entry threshold (e.g. 100 spins) or if the player's "luck level" is above or below a certain threshold.

In some embodiments, the system detects whether an event occurs on a specific wagering game or type of wagering game machine provided by a specific manufacturer. The system tracks a history of play on given manufacturers' games, within a given casino for a given time period. In some embodiments, the system can provide a player with extra bonus games, or other prizes, if a player's luck was low on the specific types of games or machines from the specific manufacturer.

Competition Based on Luck Factors.

In some embodiments, the system can provide a competition based on luck (e.g., similar to a fantasy sports competition), where a player can select specific players accounts to compete. The competition is to determine which player has assembled the best fantasy team based on final luck values over a season of gaming events. The system can provide statistics about how well a player's selected team is doing.

Luck Factor Compared to Spending.

In some embodiments, the system can track the luck factor based on how much the player has spent and provide better rewards for those who have spent more.

Real-World Luck Game.

In some embodiments, the system can provide a social game where players can bet on whether they are luckier in life based on real-world events, not just game events.

Share or Gift Luck.

In some embodiments, the system can provide a feature where one player's luck can influence features, enable enhanced pay tables, etc. at nearby machines or with friends. In some embodiments, the system can provide a way for players to sell or gift their luck values from their player account directly to another player account. In some embodiments, the system can provide a way for players to promote their own luck factors over time.

Match Players Based on Luck.

In some embodiments, the system can provide a mobile application that runs in the background and searches for other players that are also running that application in the background. The players are compared to each other and the system will either deem them an acceptable match or not based on a number of factors (win/loss ratio, luck levels, etc.). For instance, a short slot tournament of ten spins is started between two players. One player has won many more times the other player, but the other player has a high "lucky level" and, therefore, is deemed a match. If the lucky player wins, that player will win a higher reward than normal. However if the player's luck level was normal or below, the two players would not be matched up.

Example Operating Environments

This section describes example operating environments, systems, networks, etc. and presents structural aspects of some embodiments.

Wagering Game System Architecture

Figure 6:
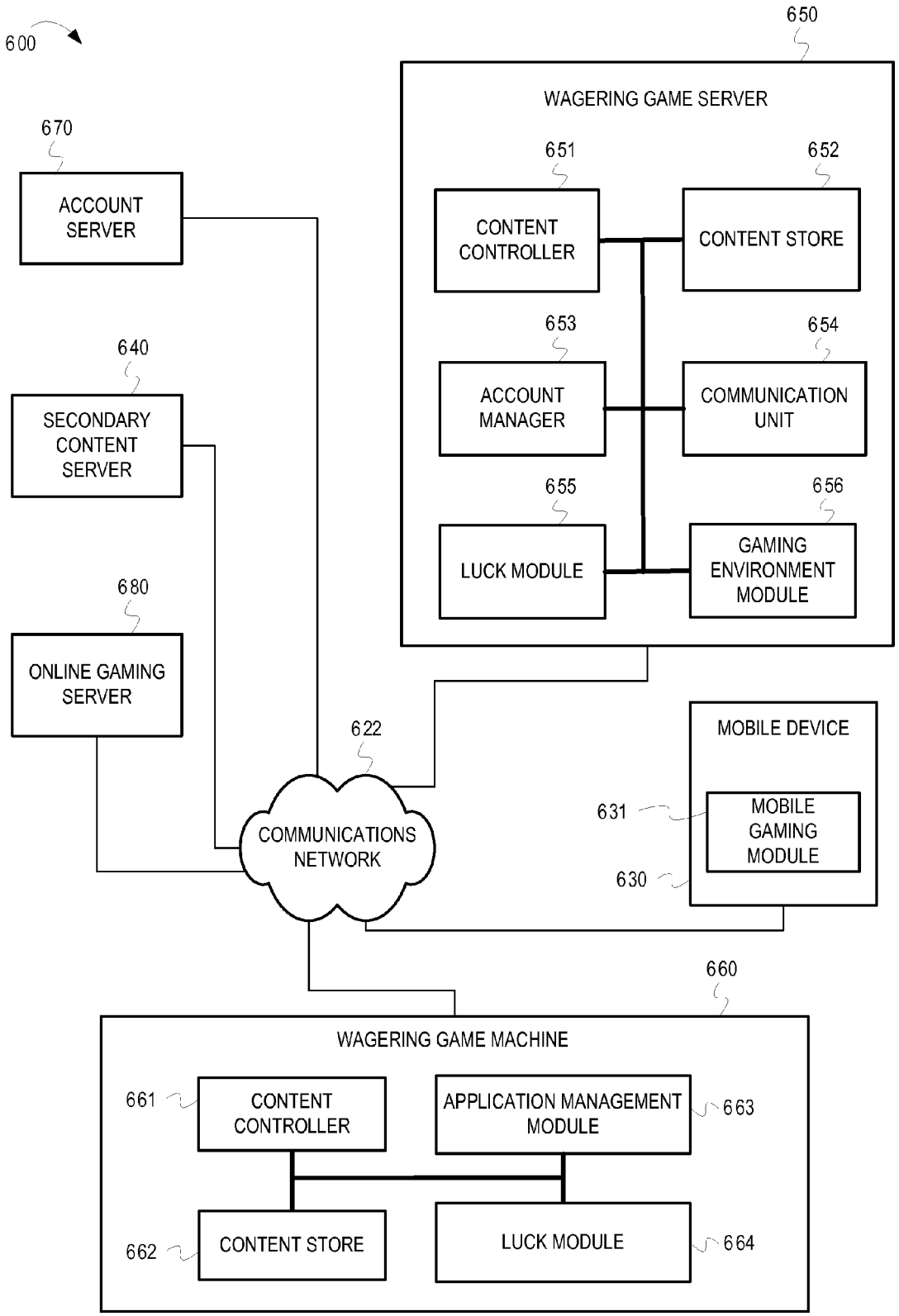
FIG. 6 is an illustration of a wagering game system architecture 600, according to some embodiments.

FIG. 6 is a conceptual diagram that illustrates an example of a wagering game system architecture 600, according to some embodiments. The wagering game system architecture 600 can include an account server 670 configured to control user related accounts accessible via wagering game networks and social networking networks. The account server 670 can store wagering game player account information, such as account settings (e.g., settings related to group games, etc., settings related to social contacts, etc.), preferences (e.g., player preferences regarding content presentable via an application of a mobile device, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 670 can contain lists of social contacts referenced by a player account. The account server 670 can also provide auditing capabilities, according to regulatory rules. The account server 670 can also track performance of players, machines, and servers.

The wagering game system architecture 600 can also include a wagering game server 650 configured to control wagering game content, provide random numbers, and communicate wagering game information, account information, and other information to and from a wagering game machine 660. The wagering game server 650 can include a content controller 651 configured to manage and control content for presentation on the wagering game machine 660. For example, the content controller 651 can generate game results (e.g., win/loss values), including win amounts, for games played on the wagering game machine 660. The content controller 651 can communicate the game results to the wagering game machine 660. The content controller 651 can also generate random numbers and provide them to the wagering game machine 660 so that the wagering game machine 660 can generate game results. The wagering game server 650 can also include a content store 652 configured to contain content to present on the wagering game machine 660. The wagering game server 650 can also include an account manager 653 configured to control information related to player accounts. For example, the account manager 653 can communicate wager amounts, game results amounts (e.g., win amounts), bonus game amounts, etc., to the account server 670. The wagering game server 650 can also include a communication unit 654 configured to communicate information to the wagering game machine 660 and to communicate with other systems, devices and networks. The wagering game server 650 can also include a luck module 655 configured to detect an occurrence of an event, detect a difference between occurrence of the event and a theoretical occurrence, and compute a luck factor. The wagering game server 650 can also include a gaming environment module 656 configured to present environmental light and sound effects in a casino environment. The gaming environment module 656 is further configured to provide content data, user data, and control information regarding gaming effects within a casino environment. For example, the gaming environment module 656 can coordinate a synchronized presentation of lighting and sound effects across a bank of wagering game machines and/or other lighting and sound producing devices within one or more areas of a casino. The gaming environment module 656 can also be configured to detect gaming events, such as events generated by the wagering game server 650 and/or the wagering game machine 660. The gaming environment module 656 can generate data for a synchronized light/sound show based on the gaming events. The gaming environment module 656 can control environmental light presentation devices within a casino. The gaming environment module 656 can provide emotive lighting presentation data, including light presentation commands on emotive lighting devices on or near wagering game machines, as well as other devices within the casino such as spotlights, overhead emotive lighting, projectors, etc. The gaming environment module 656 can be configured to determine multi-media, casino-content, including casino-wide special effects that include sound effects and light effects. The multi-media casino content can be presentable across a plurality of casino content presentation devices ("presentation devices") in a casino. The multi-media, casino-content effect can be related to a wagering game presentation or event. The wagering game presentation or event can be tied to the functionality, activity, or purpose of a wagering game. For instance, wagering game presentations can be related to attracting wagering game players to groups of wagering game machines, presenting game related outcomes across multiple wagering game machines, expressing group gaming activity across multiple wagering game machines, focusing attention on a particular person or machine in response to a gaming event, etc. The presentation devices present sound and light effects that accompany a gaming event (e.g., a jackpot celebratory effect that focuses on a wagering game machine, a lightning strike that introduces a community gaming event, and a musical chair game that reveals a community wagering game winner). The gaming environment module 656 can also be configured to determine timing control data for the multi-media effect. In some embodiments, timing control data can be stored on the wagering game server 650, or be accessible to the gaming environment module 656 via another device (e.g., a lighting controller associated with a bank of wagering game machines), to use to send lighting commands in sequential order to network addresses of presentation device on a casino network. The gaming environment module 656 can determine channels assigned with casino-content presentation devices, such as the wagering game machine 660. In some embodiments, the presentation devices can have addresses assigned to a channel. For example, the wagering game machine 660 could be on one channel, peripheral devices could be on another channel, network light presentation devices can be on other channels, etc. In some embodiments, the gaming environment module 656 can be a DMX controller connected in parallel to an emotive lighting controller on, or associated with, the wagering game machine 660. The DMX controller can also be connected in parallel to a plurality of other presentation devices (e.g., other wagering game machines, lighting presentation devices, etc.) within a casino, and can simultaneously provide DMX lighting commands to the wagering game machine 660 and to the other presentation devices. DMX can change light intensity, or other light characteristics, over time. Some embodiments of DMX controllers can update commands very quickly (e.g., 30-47 times a second) across multiple channels (e.g., 512 channels). A DMX controller can put different commands in every channel (e.g., one channel can have show "X," one channel can have show "Y," etc.). The DMX can also have a frame number within a show. Some devices can take up more than one channel (e.g., an emotive light might have three colors and may take up a channel for each color, a spotlight might have seven channels, etc.). Each device can receive 512 bytes of data from the DMX controller at any given time interval (e.g., frame). The 512 bytes of data can be divided in different ways. For example, 6 bytes may address light effect behavior, 6 bytes may include show numbers, 6 bytes may include frame numbers, 1 byte may include priority values, and so on for various light effect characteristics (e.g., intensity, color, pan, tilt, etc.). The presentation device that receives the DMX command data is programmed to interpret the lighting data in the channel. In some embodiments, the presentation devices can be DMX compliant including having a DMX input port to accept DMX commands. In some embodiments, presentation devices can convert the DMX commands to proprietary commands. In addition to the DMX protocol, other types of dedicated lighting protocols can include AMX 192, CMX, SMX, PMX, protocols included in the EIA-485 standard, etc.

The wagering game system architecture 600 can also include the wagering game machine 660 configured to present wagering games and receive and transmit information between the wagering game machine 660 and the mobile device 630. The wagering game machine 660 can include a content controller 661 configured to manage and control content and presentation of content on the wagering game machine 660. The wagering game machine 660 can also include a content store 662 configured to contain content to present on the wagering game machine 660. The wagering game machine 660 can also include an application management module 663 configured to manage multiple instances of gaming applications. For example, the application management module 663 can be configured to launch, load, unload and control applications and instances of applications. The application management module 663 can launch different software players (e.g., a Microsoft® Silverlight™ player, an Adobe® Flash® player, etc.) and manage, coordinate, and prioritize what the software players do. The application management module 663 can also coordinate instances of server applications in addition to local copies of applications. The application management module 663 can control window locations on a wagering game screen or display for the multiple gaming applications. In some embodiments, the application management module 663 can manage window locations on multiple displays including displays on devices associated with and/or external to the wagering game machine 660 (e.g., a top display and a bottom display on the wagering game machine 660, a peripheral device connected to the wagering game machine 660, a mobile device connected to the wagering game machine 660, etc.). The application management module 663 can manage priority or precedence of client applications that compete for the same display area. For instance, the application management module 663 can determine each client application's precedence.

The precedence may be static (i.e. set only when the client application first launches or connects) or dynamic. The applications may provide precedence values to the application management module 663, which the application management module 663 can use to establish order and priority. The precedence, or priority, values can be related to tilt events, administrative events, primary game events (e.g., hierarchical, levels, etc.), secondary game events, local bonus game events, advertising events, etc. As each client application runs, it can also inform the application management module 663 of its current presentation state. The applications may provide presentation state values to the application management module 663, which the application management module 663 can use to evaluate and assess priority. Examples of presentation states may include celebration states (e.g., indicates that client application is currently running a win celebration), playing states (e.g., indicates that the client application is currently playing), game starting states (e.g., indicates that the client application is showing an invitation or indication that a game is about to start), status update states (e.g., indicates that the client application is not 'playing' but has a change of status that should be annunciated, such as a change in progressive meter values or a change in a bonus game multiplier), idle states (e.g., indicates that the client application is idle), etc. In some embodiments, the application management module 663 can be pre-configurable. The system can provide controls and interfaces for operators to control screen layouts and other presentation features for the configuring of the application management module 663. The application management module 663 can communicate with, and/or be a communication mechanism for, a base game stored on a wagering game machine. For example, the application management module 663 can communicate events from the base game such as the base game state, pay line status, bet amount status, etc. The application management module 663 can also provide events that assist and/or restrict the base game, such as providing bet amounts from secondary gaming applications, inhibiting play based on gaming event priority, etc. The application management module 663 can also communicate some (or all) financial information between the base game and other applications including amounts wagered, amounts won, base game outcomes, etc. The application management module 663 can also communicate pay table information such as possible outcomes, bonus frequency, etc. In some embodiments, the application management module 663 can control different types of applications. For example, the application management module 663 can perform rendering operations for presenting applications of varying platforms, formats, environments, programming languages, etc. For example, the application management module 663 can be written in one programming language format (e.g., JavaScript, Java, C++, etc.) but can manage, and communicate data from, applications that are written in other programming languages or that communicate in different data formats (e.g., Adobe® Flash®, Microsoft® Silverlight™, Adobe® Air™, hyper-text markup language, etc.). The application management module 663 can include a portable virtual machine capable of generating and executing code for the varying platforms, formats, environments, programming languages, etc. The application management module 663 can enable many-to-many messaging distribution and can enable the multiple applications to communicate with each other in a cross-manufacturer environment at the client application level. For example, multiple gaming applications on a wagering game machine may need to coordinate many different types of gaming and casino services events (e.g., financial or account access to run spins on the base game and/or run side bets, transacting drink orders, tracking player history and player loyalty points, etc.).

The wagering game machine 660 can also include a luck module 664 configured to detect an occurrence of an event, detect a difference between occurrence of the event and a theoretical occurrence, and compute a luck factor.

The wagering game system architecture 600 can also include the secondary content server 640 configured to provide content and control information for secondary games and other secondary content available on a wagering game network (e.g., secondary wagering game content, promotions content, advertising content, player tracking content, web content, etc.). The secondary content server 640 can provide "secondary" content, or content for "secondary" games presented on the wagering game machine 660. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the secondary content can be in one or more different formats, such as Adobe® Flash®, Microsoft® Silverlight™, Adobe® Air™, hyper-text markup language, etc. In some embodiments, the secondary content server 640 can provide and control content for community games, including networked games, social games, competitive games, or any other game that multiple players can participate in at the same time. In some embodiments, the secondary content server 640 can control and present an online website that hosts wagering games. The secondary content server 640 can also be configured to present multiple wagering game applications on the wagering game machine 660 via a wagering game website, or other gaming-type venue accessible via the Internet. The secondary content server 640 can host an online wagering website and/or a social networking website. The secondary content server 640 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The secondary content server 640 can also be configured to provide content presentable via an application of the mobile device 630. In some embodiments, the secondary content server 640 can also host social networking accounts, provide social networking content, control social networking communications, store associated social contacts, etc. The secondary content server 640 can also provide chat functionality for a social networking website, a chat application, or any other social networking communications mechanism. In some embodiments, the secondary content server 640 can utilize player data to determine marketing promotions that may be of interest to a player account. The secondary content server 640 can also analyze player data and generate analytics for players, group players into demographics, integrate with third party marketing services and devices, etc. The secondary content server 640 can also provide player data to third parties that can use the player data for marketing. In some embodiments, the secondary content server 640 can provide one or more social networking communication mechanisms that publish (e.g., post, broadcast, etc.) a message to a mass (e.g., to multiple people, users, social contacts, accounts, etc.). The social networking communication mechanism can publish the message to the mass simultaneously. Examples of the published message may include, but not be limited to, a blog post, a mass message post, a news feed post, a profile status update, a mass chat feed, a mass text message broadcast, a video blog, a forum post, etc. Multiple users and/or accounts can access the published message and/or receive automated notifications of the published message.

The wagering game system architecture 600 can also include the online gaming server 680 configured to control and present a website that hosts gaming related content (e.g., wagering games, non-wagering games that share common themes to wagering games, social networking content related to gaming, etc.). The online gaming server 680 can be configured to present multiple applications on the website via the Internet. The online gaming server 680 can host a social network. The online gaming server 680 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The online gaming server 680 can also be configured to provide content presentable via an application of the mobile device 630.

The wagering game system architecture 600 can also include the mobile device 630 configured to control mobile communications and applications. The mobile device 630 may also be referred to as a handheld device, a handheld computer or simply handheld. In some embodiments, the mobile device 630 is a pocket-sized computing device, having a display screen with touch input and/or a miniature keyboard. Some examples of the mobile device 630 may include, but are not limited to, a smartphone, a personal digital assistant, a mobile computer, a mobile internet device, a portable media player, a mobile phone, a pager, a personal navigation device, etc. In some embodiments, the mobile device 630 functions via a wireless application protocol (WAP). In some embodiments, the mobile device 630 may include integrated data capture devices like barcode readers, radio frequency identification (RFID) readers, In-cell Optical LCD readers, and smart card readers. In some embodiments the mobile device 630 is personal (i.e., belongs to a user), which the user can carry on their person. The mobile device 630 can include a mobile gaming module 631 configured to communicate with wagering game devices, such as the wagering game server 650, the wagering game machine 660, the online gaming server 680, the secondary content server 640, and the account server 670. Further, the mobile gaming module 631 is configured to provide information about the mobile device 630 to the wagering game devices. The mobile gaming module 630 is further configured to present content related to gaming, via an application of the mobile device 630, while the mobile device 630 is inside or outside a casino.

Each component shown in the wagering game system architecture 600 is shown as a separate and distinct element connected via a communications network 622. However, some functions performed by one component could be performed by other components. For example, the wagering game server 650 can also be configured to perform functions of the application management module 663, and other network elements and/or system devices. Furthermore, the components shown may all be contained in one device, but some, or all, may be included in, or performed by, multiple devices, as in the configurations shown in FIG. 6 or other configurations not shown. For example, the account manager 653 and the communication unit 654 can be included in the wagering game machine 660 instead of, or in addition to, being a part of the wagering game server 650. Further, in some embodiments, the wagering game machine 660 can determine wagering game outcomes, generate random numbers, etc. instead of, or in addition to, the wagering game server 650.

The wagering game machines described herein (e.g., wagering game machine 660) can take any suitable form, such as floor standing models, handheld mobile wagering game machines, bar-top models, workstation-type console models, surface computing machines, etc. Further, wagering game machines can be primarily dedicated for use in conducting wagering games.

In some embodiments, wagering game machines and wagering game servers work together such that wagering game machines can be operated as thin, thick, or intermediate clients. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 600 can be implemented as software, hardware, any combination thereof, or other forms of embodiments not listed. For example, any of the network components (e.g., the wagering game machines, servers, etc.) can include hardware and machine-readable storage media including instructions for performing the operations described herein.

Wagering Game Machine Architecture

Figure 7:
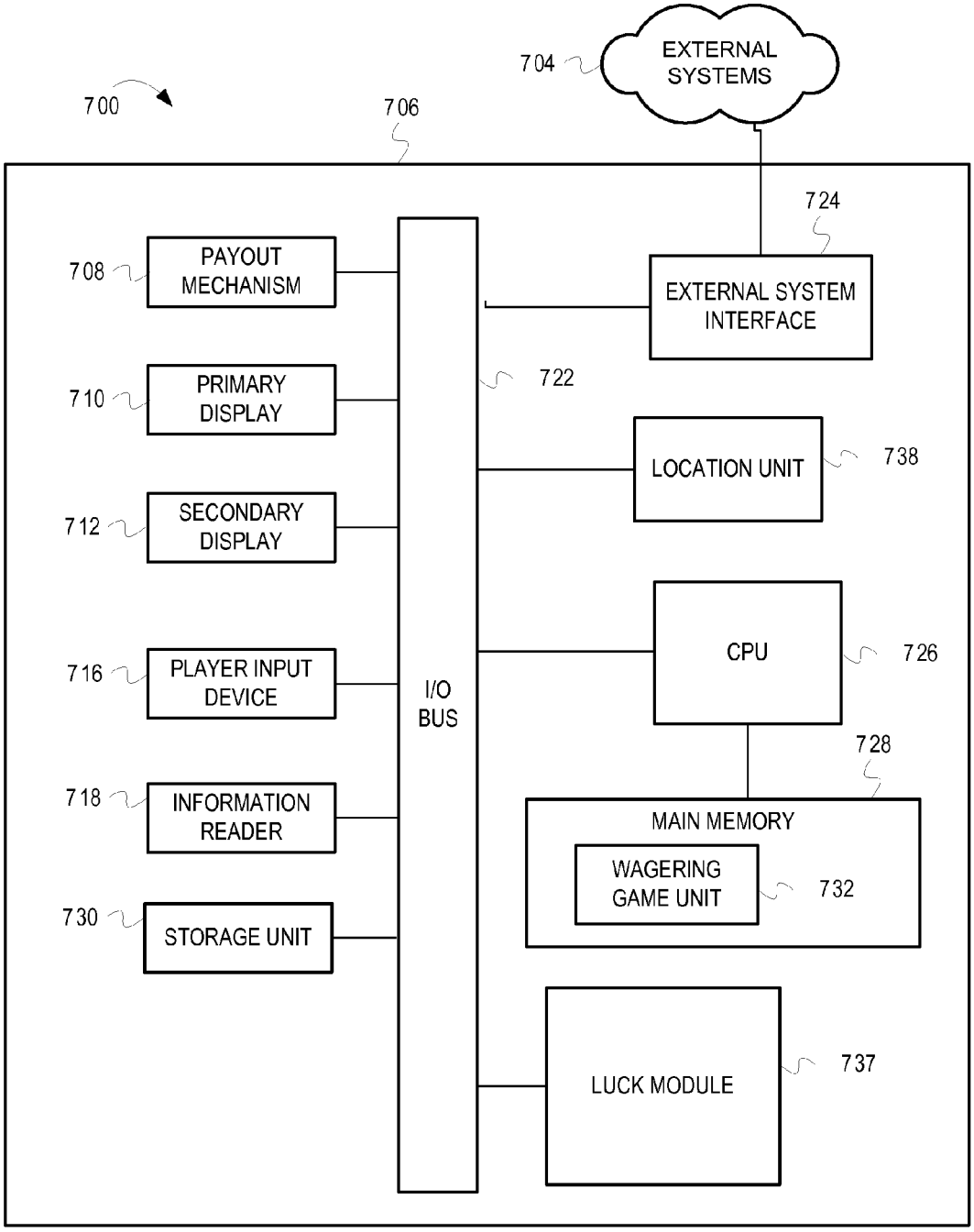
FIG. 7 is an illustration of a wagering game machine architecture 700, according to some embodiments.

FIG. 7 is a conceptual diagram that illustrates an example of a wagering game machine architecture 700, according to some embodiments. In FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In some embodiments, the wagering game unit 732 can present wagering games, such as video poker, video black jack, video slots, video lottery, reel slots, etc., in whole or part.

The CPU 726 is also connected to an input/output ("I/O") bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks). The external system interface 724 can include logic for exchanging information over wired and wireless networks (e.g., 802.11g transceiver, Bluetooth transceiver, Ethernet transceiver, etc.)

The I/O bus 722 is also connected to a location unit 738. The location unit 738 can create player information that indicates the wagering game machine's location/movements in a casino. In some embodiments, the location unit 738 includes a global positioning system (GPS) receiver that can determine the wagering game machine's location using GPS satellites. In other embodiments, the location unit 738 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 7, in some embodiments, the location unit 738 is not connected to the I/O bus 722.

In some embodiments, the wagering game machine 706 can include additional peripheral devices and/or more than one of each component shown in FIG. 7. For example, in some embodiments, the wagering game machine 706 can include multiple external system interfaces 724 and/or multiple CPUs 726. In some embodiments, any of the components can be integrated or subdivided.

In some embodiments, the wagering game machine 706 includes a luck module 737. The luck module 737 can process communications, commands, or other information, where the processing can compute wagering game luck.

Furthermore, any component of the wagering game machine 706 can include hardware, firmware, and/or machine-readable storage media including instructions for performing the operations described herein.

Wagering Game System

Figure 8:
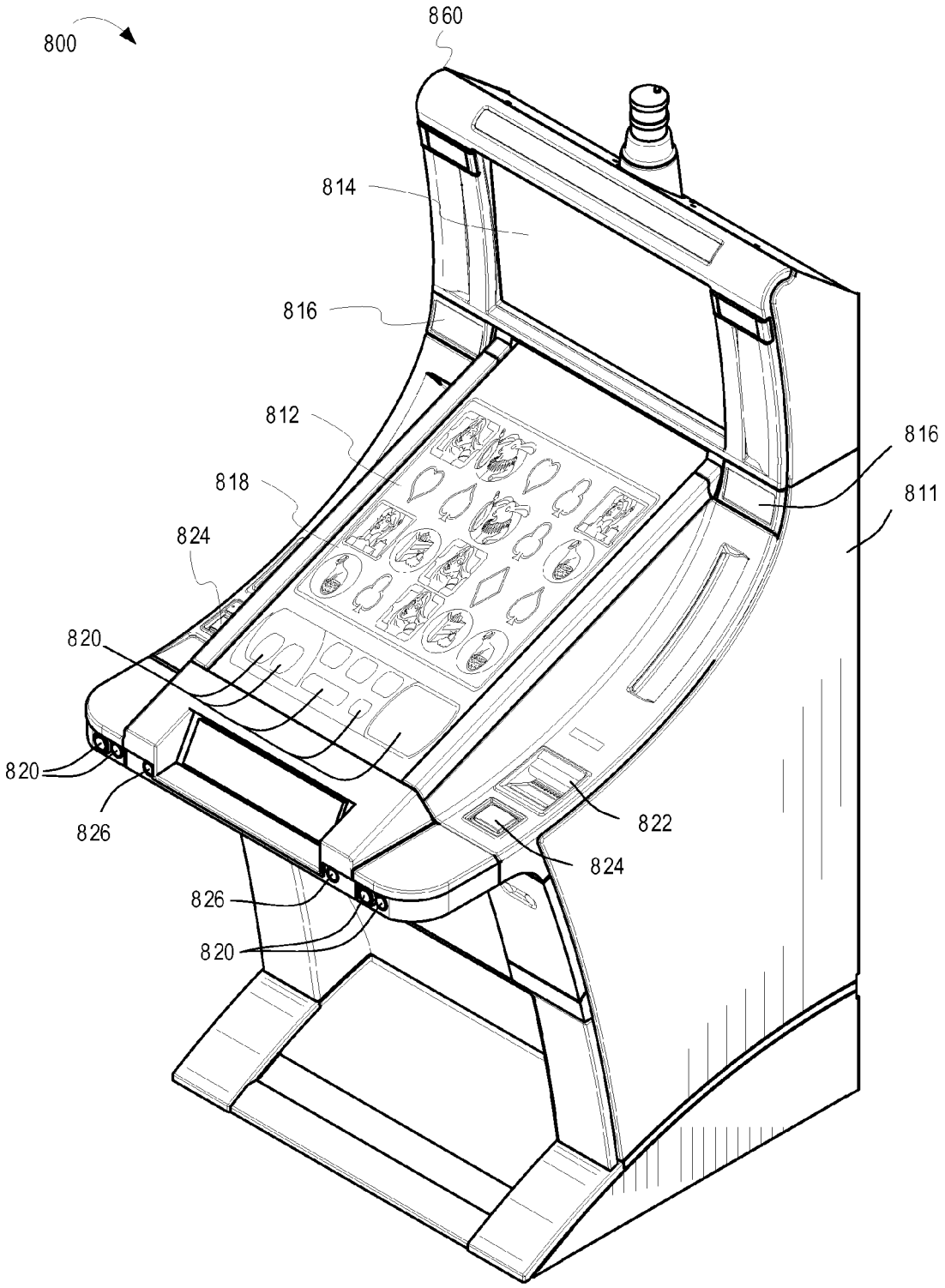
FIG. 8 is an illustration of a wagering game system 800, according to some embodiments.

FIG. 8 is a conceptual diagram that illustrates an example of a wagering game system 800, according to some embodiments. In FIG. 8, the wagering game system 800 includes a wagering game machine 860 similar to those used in gaming establishments, such as casinos. The wagering game machine 860 may, in some examples, be referred to as a gaming terminal or an electronic gaming machine. The wagering game machine 860 may have varying structures and methods of operation. For example, the wagering game machine 860 may include electromechanical components configured to play mechanical slots. In another example, the 860 includes electronic components configured to play a video casino game, such as slots, keno, poker, blackjack, roulette, craps, etc. The wagering game machine 860 is depicted as a floor-standing model. However, other examples of wagering game machines include handheld mobile units, bartop models, workstation-type console models, etc. Further, the wagering game machine 860 may be primarily dedicated for use in conducting wagering games, or may include non-dedicated devices, such as mobile phones, personal digital assistants, personal computers, etc. Exemplary types of wagering game machines are disclosed in U.S. Pat. No. 6,517,433 and Patent Application Publication Nos. US2010/0062196 and US2010/0234099, which are incorporated herein by reference in their entireties.

The wagering game machine 860 illustrated in FIG. 8 comprises a cabinet 811 that may house various input devices, output devices, and input/output devices. By way of example, the wagering game machine 860 includes a primary display area 812, a secondary display area 814, and one or more audio speakers 816. The primary display area 812 or the secondary display area 814 may include one or more of a cathode ray tube (CRT), a high resolution liquid crystal display (LCD), a plasma display, a light emitting diode (LED) display, a three-dimensional (3D) display, a video display, or a combination thereof. In some examples, the primary display area 812 or the secondary display area 814 includes mechanical reels to display a wagering game outcome. In some example, the primary display area 812 or the secondary display area 814 present a transmissive video display disposed in front of a mechanical-reel display to portray a video image superimposed upon the mechanical-reel display. In FIG. 8, the wagering game machine 860 is a "slant-top" version in which the primary display 812 is slanted (e.g., at about a thirty-degree angle toward the player of the wagering game machine 860). Another example of wagering game machine 860 is an "upright" version in which the primary display 814 is oriented vertically relative to the player. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the wagering game machine 860. The wagering game machine 860 includes a touch screen(s) 818 mounted over the primary or secondary areas, buttons 820 on a button panel, bill validator 822, information reader/writer(s) 824, and player-accessible port(s) 826 (e.g., audio output jack for headphones, video headset jack, USB port, wireless transmitter/receiver, etc.). It should be understood that numerous other peripheral devices and other elements exist and are readily utilizable in any number of combinations to create various forms of a wagering game machine in accord with the present concepts.

Input devices, such as the touch screen 818, buttons 820, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product that may include a machine-readable storage medium having stored thereon instructions, which may be used to program a computer system to perform a process according to embodiments(s), whether presently described or not, because every conceivable variation is not enumerated herein. A machine-readable storage medium includes any mechanism that stores information in a form (e.g., software, processing application) readable by a machine (e.g., a computer). For example, machine-readable storage media includes magnetic storage medium (e.g., floppy diskette), read only memory (ROM), random access memory (RAM), magnetic disk storage media, optical storage media (e.g., CD-ROM), magneto-optical storage media, flash memory, erasable programmable memory (e.g., EPROM and EEPROM), or other types of media suitable for storing electronic instructions. In addition, embodiments may be embodied in a machine-readable signal media, such as any media suitable for transmitting software over a network.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a gaming system configured with one or more wagering game controllers and an electronic display device, said method comprising:

receiving, via a value input device of the gaming system, physical money for placement of one or more wagers on a casino wagering game presented via the electronic display device;

specifying, in a credit meter of the gaming system, an indication of credits that correspond to a value of the physical money;

accessing a first portion of the credits for placement of a first wager in the casino wagering game;

initiating a first playing round of the casino wagering game;

computing, by at least one of the one or more wagering game controllers, a random wagering game event for the first playing round of the casino wagering game, wherein a player account is associated with the casino wagering game, and wherein the random wagering game event is associated with one or more of a first pay table or a first set of symbols for the casino wagering game;

determining a theoretical expected value for the random wagering game event;

determining, by at least one of the one or more wagering game controllers, a degree to which an actual value of the random wagering game event varies from the theoretical expected value for the of the random wagering game event;

computing, by at least one of the one or more wagering game controllers, a number of luck points, wherein the number of luck points represents a degree of luck proportional to the degree to which the actual value of the random wagering game event varies from the theoretical expected value of the random wagering game event;

adding the number of luck points to a luck score associated with the player account;

providing the luck score for presentation on the electronic display device via a luck meter separate from the credit meter;

determining, in response to user input received via a control device of the gaming system, a request to redeem at least a portion of the luck points;

in response to the request to redeem the at least the portion of the luck points, changing one or more of the first pay table to a second pay table for the casino wagering game or the first set of symbols to a second set of symbols used in the casino wagering game to represent a wagering game outcome;

subtracting an amount of the at least the portion of the luck points from the luck meter in response to redemption of the at least the portion of the luck points;

initiating a second playing round using a second portion of the credits, wherein the second playing round utilizes the one or more of the second pay table or the second set of symbols; and changing a value of the credit meter according to an award received based on the second playing round.

2. The method of claim 1, wherein the adding the number of luck points to the luck score associated with the player account comprises one or more of increasing the luck score when the actual value for the random wagering game event is greater than the theoretical expected value for the random wagering game event, and decreasing the luck score when the actual value for the random wagering game event is less the theoretical expected value of the random wagering game event.

3. The method of claim 1, wherein the theoretical expected value of the random wagering game event comprises one or more of a probability of occurrence of the random wagering game event, a frequency of occurrence of the random wagering game event, a sequence of occurrence of the random wagering game event, a level of occurrence of the random wagering game event, a timing of occurrence of the random wagering game event, an order of occurrence of the random wagering game event, a money value of the random wagering game event, an intensity of presentation of the random wagering game event, and a duration of presentation of the random wagering game event.

4. The method of claim 1, wherein the determining the degree to which the actual value of the random wagering game event varies from the theoretical expected value for the random wagering game event comprises:

analyzing a history of previous occurrences of the random wagering game event from wagering game play for the player account;

computing the theoretical expected value for the random wagering game event based on the history of the previous occurrences of the random wagering game event; and evaluating the actual value of the random wagering game event against the theoretical expected value.

5. The method of claim 1, wherein determining the degree to which the actual value of the random wagering game event varies from the theoretical expected value comprises accessing a first set of rules separate from a second set of rules for the casino wagering game.

6. The method of claim 1 further comprising selecting wagering game content based on a degree to which the luck score exceeds a threshold value, wherein the wagering game content is other than a presentation of the luck points and the luck score.

7. The method of claim 6, wherein the selecting the wagering game content based on the degree to which the luck score exceeds the threshold value comprises one or more of determining a degree to which the luck score exceeds an additional luck score associated with an additional player account, and determining a degree to which the luck score exceeds a threshold ranking.

8. The method of claim 1 wherein the theoretical expected value of the random wagering game event is an average payout value for occurrence of the random wagering game event, and wherein the actual value of the random wagering game event is an actual payout that occurs for the random wagering game event different from the average payout value.

9. The method of claim 1 further comprising using the luck score as a gaming outcome associated with a second wagering game.

10. The method of claim 1 further comprising:

initiating a third playing round of the casino wagering game;

computing, by at least one of the one or more wagering game controllers, a degree of negative luck based on an event from the third playing round;

subtracting an amount of luck points from the luck score according to the degree of negative luck; and providing additional content for presentation via the gaming system in response to computing the negative luck.

11. One or more non-transitory machine-readable storage devices having instructions stored thereon, which when executed by a set of one or more processors of a gaming system cause the set of one or more processors to perform operations comprising:

receiving, via a value input device of the gaming system, physical money for placement of one or more wagers on a casino wagering game presented via an electronic display device;

specifying, in a credit meter of the gaming system, an indication of credits that correspond to a value of the physical money;

accessing a first portion of the credits for placement of a first wager in the casino wagering game;

initiating a first playing round of the casino wagering game;

computing a random wagering game event for the first playing round of the casino wagering game, wherein a player account is associated with the casino wagering game, and wherein the random wagering game event is associated with one or more of a first pay table or a first set of symbols for the casino wagering game;

determining a theoretical expected value for the random wagering game event;

determining a degree to which an actual value of the random wagering game event varies from the theoretical expected value for the random wagering game event;

computing a number of luck points, wherein the number of luck points represents a degree of luck proportional to the degree to which the actual value of the random wagering game event varies from the theoretical expected value of the random wagering game event;

adding the number of luck points to a luck score associated with the player account;

providing the luck score for presentation via the electronic display device via a luck meter separate from the credit meter;

determining, in response to user input received via a control device of the gaming system, a request to redeem at least a portion of the luck points;

in response to the request to redeem the at least the portion of the luck points, changing one or more of the first pay table to a second pay table for the casino wagering game or the first set of symbols to a second set of symbols used in the casino wagering game to represent a wagering game outcome;

subtracting an amount of the at least the portion of the luck points from the luck meter in response to redemption of the at least the portion of the luck points;

initiating a second playing round using a second portion of the credits, wherein the second playing round utilizes the one or more of the second pay table or the second set of symbols; and changing a value of the credit meter according to an award received based on the second playing round.

12. The one or more non-transitory machine-readable storage devices of claim 11, wherein the operation of adding the number of luck points to the luck score includes operations comprising one or more of increasing the luck score when the actual value for the random wagering game event is greater than the theoretical expected value for the random wagering game event, and decreasing the luck score when the actual value for the random wagering game event is less than the theoretical expected value for the random wagering game event.

13. The one or more non-transitory machine-readable storage devices of claim 11, wherein the theoretical expected value for the random wagering game event comprises one or more of a probability of occurrence of the random wagering game event, a frequency of occurrence of the random wagering game event, a sequence of occurrence of the random wagering game event, a level of occurrence of the random wagering game event, a timing of occurrence of the random wagering game event, an order of occurrence of the random wagering game event, a money value of the random wagering game event, an intensity of presentation of the random wagering game event, and a duration of presentation of the random wagering game event.

14. The one or more non-transitory machine-readable storage devices of claim 11, wherein the luck score is different from a value of a metric generated based on game rules for the casino wagering game.

15. The one or more non-transitory machine-readable storage devices of claim 11, said operations further comprising one or more of ranking and awarding player accounts based on the luck score.

16. The one or more non-transitory machine-readable storage devices of claim 11, said operations further comprising one or more of electronically evaluating the luck score to an additional luck score associated with an additional player account and electronically providing, for presentation via the electronic display device, a playing strategy for the player account to play against the additional player account based on the electronically evaluating.

17. The one or more non-transitory machine-readable storage devices of claim 11, wherein the operation of determining the degree to which the actual value of the random wagering game event varies from the theoretical expected value for the random wagering game event comprises an operation for accessing a first set of rules separate from a second set of rules for the casino wagering game.

18. A gaming system comprising:

at least one processor;

a random event generator configured to generate random wagering game events;

an electronic display device;

a value input device configured to receive physical money for placement of one or more wagers on a casino wagering game presented via the electronic display device; and a memory configured to store instructions, which when executed by the at least one processor cause the gaming system to specify, in a credit meter of the gaming system, an indication of credits that correspond to a value of the physical money, access a first portion of the credits for placement of a first wager in the casino wagering game, initiate a first playing round of the casino wagering game, compute, via the random event generator, a random wagering game event for the first playing round of the casino wagering game, wherein a player account is associated with the casino wagering game, and wherein the random wagering game event is associated with one or more of a first pay table or a first set of symbols for the casino wagering game, determine a theoretical expected occurrence frequency for the random wagering game event, determine a degree to which an actual value of the random wagering game event varies from the theoretical expected occurrence frequency of the random wagering game event, compute a number of luck points which represents a degree of luck proportional to the degree to which the actual value of the random wagering game event varies from the theoretical expected occurrence frequency of the random wagering game event, add the number of luck points to a luck score associated with the player account, provide the luck score via a luck meter separate from the credit meter for presentation during the casino wagering game via the electronic display device, determine, in response to user input received via a control device of the gaming system, a request to redeem at least a portion of the luck points, in response to the request to redeem the at least the portion of the luck points, change one or more of the first pay table to a second pay table for the casino wagering game or the first set of symbols to a second set of symbols used in the casino wagering game to represent a wagering game outcome, subtract an amount of the at least the portion of the luck points from the luck meter in response to redemption of the at least the portion of the luck points, initiate a second playing round using a second portion of the credits, wherein the second playing round utilizes the one or more of the second pay table or the second set of symbols, and change a value of the credit meter according to an award received based on the second playing round.

19. The gaming system of claim 18, wherein the memory is configured to store instructions, which when executed by the at least one processor, cause the gaming system to calculate a degree to which the random wagering game event is less likely to occur because a non-optimal playing strategy was played for the casino wagering game prior to occurrence of the random wagering game event, determine the degree to which the actual value of the random wagering game event varies from the theoretical expected occurrence frequency of the random wagering game event occurred based, at least in part, on the degree to which the random wagering game event is less likely to occur, and increase the luck score proportional to the degree to which the actual value of the random wagering game event varies from the theoretical expected occurrence frequency of the random wagering game event occurred, wherein the increase in the luck score indicates luck that the random wagering game event occurred despite being less likely to occur because of the non-optimal playing strategy.

20. The gaming system of claim 18, wherein the memory is configured to store instructions, which when executed by the at least one processor, cause the gaming system to select wagering game content for one or more additional playing rounds based on the luck score.

21. The gaming system of claim 18, wherein the memory is configured to store instructions, which when executed by the at least one processor, cause the gaming system to one or more of increase the luck score when the actual value of the random wagering game event is greater than the theoretical expected occurrence frequency of the random wagering game event, and decrease the luck score when the actual value of the random wagering game event is less than the theoretical expected occurrence frequency of the random wagering game event.

22. The gaming system of claim 18, wherein the memory is configured to store instructions which, when executed by the at least one processor, cause the gaming system to determine the actual value based on data from the casino wagering game, determine a theoretical expected value of the theoretical expected occurrence frequency from a first set of rules separate from a second set of rules for the casino wagering game, evaluate the actual value against the theoretical expected value, and determine that the actual value is different from the theoretical expected value.

23. The gaming system of claim 22, wherein the memory is configured to store instructions which, when executed by the at least one processor, cause the gaming system to detect a characteristic of the random wagering game event, and detect that the characteristic is indicated in the first set of rules as a criteria that qualifies the random wagering game event for computation of the number of luck points.

24. The gaming system of claim 23, wherein the memory is configured to store instructions which, when executed by the at least one processor, cause the gaming system to detect a luck parameter in the first set of rules, wherein the luck parameter is associated with the characteristic indicated in the first set of rules, and use the luck parameter to generate the luck score.

25. The gaming system of claim 18, wherein the memory is configured to store instructions which, when executed by the at least one processor, cause the gaming system to one or more of compute a positive numerical value for the luck points when the actual value of the random wagering game event is greater than a theoretical expected value of the theoretical expected occurrence frequency for the of the random wagering game event and compute a negative numerical value for the luck points when the actual value of the random wagering game event is less than a theoretical expected value of the theoretical expected occurrence frequency for the of the random wagering game event.

26. The method of claim 10 further comprising:

determining a history of luck computations associated with the player account for a given provider of the gaming system; and accessing a data store associated with the provider to obtain the additional content.

* * * * *